US009412529B2

(12) United States Patent
Tian et al.

(10) Patent No.: US 9,412,529 B2
(45) Date of Patent: Aug. 9, 2016

(54) CLASPING CONNECTION STRUCTURE OF CONTACTOR

(71) Applicant: Xiamen Hongfa Electrical Safety & Controls Co., Ltd., Xiamen (CN)

(72) Inventors: Xinjiang Tian, Xiamen (CN); Changhui Xia, Xiamen (CN)

(73) Assignee: Xiamen Hongfa Electrical Safety & Controls Co., Ltd., Xiamen (CN)

( * ) Notice: Subject to any disclaimer, the term of this patent is extended or adjusted under 35 U.S.C. 154(b) by 0 days.

(21) Appl. No.: 14/741,654

(22) Filed: Jun. 17, 2015

(65) Prior Publication Data

US 2015/0380180 A1 Dec. 31, 2015

(30) Foreign Application Priority Data

| | | |
|---|---|---|
| Jun. 27, 2014 | (CN) | 2014 1 0293855 |
| Jun. 27, 2014 | (CN) | 2014 1 0293863 |
| Jun. 27, 2014 | (CN) | 2014 1 0293902 |
| Jun. 27, 2014 | (CN) | 2014 2 0346864 U |
| Jul. 10, 2014 | (CN) | 2014 2 0380050 U |
| Nov. 20, 2014 | (CN) | 2014 1 0666492 |

(51) Int. Cl.
*H01H 9/20* (2006.01)
*H01H 9/02* (2006.01)

(52) U.S. Cl.
CPC . *H01H 9/20* (2013.01); *H01H 9/02* (2013.01); *H01H 9/0207* (2013.01); *H01H 2207/036* (2013.01)

(58) Field of Classification Search
CPC . H01H 9/20; H01H 9/0207; H01H 2207/036; H01H 9/02
USPC ..... 200/293, 5 C, 295, 304–306; 335/120, 335/131–134, 139, 160, 202
See application file for complete search history.

(56) References Cited

U.S. PATENT DOCUMENTS

| | | | | |
|---|---|---|---|---|
| 4,684,772 A * | 8/1987 | Lehman | H01H 9/36 200/306 |
| 4,760,364 A * | 7/1988 | Ostby | H01H 50/22 200/293 |
| 6,417,749 B1 * | 7/2002 | Kappel | H01H 50/026 335/132 |

* cited by examiner

*Primary Examiner* — Edwin A. Leon
(74) *Attorney, Agent, or Firm* — McDonnell Boehnen Hulbert & Berghoff LLP

(57) ABSTRACT

A clasping connection structure of a contactor is disclosed, including a base, a housing and a bobbin; accommodating chambers is formed on the housing and configured to accommodate contact head therein, the accommodating chambers are separated via a side plate, the bobbin and the housing are connected via a first clasp, the first clasp is protruded and extended at a central side plate of the housing, the central side plate is located at an axial center line of the housing, correspondingly, a limiting slot for matching with the central side plate is formed on the bobbin, the bobbin is inserted in the housing, the central side plate passes through the limiting slot, the clasp of the central side plate is hooked on the bobbin at a side of the limiting slot, to connect the bobbin and the housing, the housing and the base are connected via a second clasp. The contactor of the invention is adapted to the automatic assembling, and has reduced manufacturing cost.

4 Claims, 31 Drawing Sheets

A-A

B–B

CLASPING CONNECTION STRUCTURE OF CONTACTOR

CROSS REFERENCE TO RELATED APPLICATIONS

This application claims the priority to and the benefit of Chinese Patent Application No. 20140293863.2, filed on Jun. 27, 2014 and entitled "a clasping connection structure of a contactor"; the benefit of Chinese Patent Application No. 201410293855.8, filed on Jun. 27, 2014 and entitled "an accommodating chamber structure of a wiring terminal of a coil"; the benefit of Chinese Patent Application No. 201410293902.9, filed on Jun. 27, 2014 and entitled "a cover structure of a contactor"; the benefit of Chinese Patent Application No. 201410666492.8, filed on Nov. 20, 2014 and entitled "a rail mounting structure of an electric device"; the benefit of Chinese Patent Application No. 201420380050.2, filed on Jul. 10, 2014 and entitled "a rail mounting structure of an electric device"; and the benefit of Chinese Patent Application No. 201420346864.4, filed on Jun. 27, 2014 and entitled "a rail mounting structure of an electric device", which are incorporated herein by reference in its entirety.

TECHNICAL FIELD

The present disclosure relates generally to the technical field of the contactor assembling, and particularly to a clasping connection structure of a contactor.

BACKGROUND

In the conventional technology of contactor assembling, a bobbin is firstly disposed in a housing. At that moment, the bobbin is only disposed in a chamber of the housing instead of being fixed to the housing. The housing and the base are then assembled with screws. The contactor assembling structure has defects of:

Firstly, the bobbin is easy to fall off during automatic assembling since the bobbin and the housing are not fastened with each other, which is hard to achieve automatic assembling.

Secondly, the housing is fastened to the base via screws, and the screw connection needs to be performed by human, which is hard to achieve automatic assembling.

Thirdly, using screws to fasten the housing and the base increases the usage cost of screws, which leads to a relatively high cost.

In another aspect, in the conventional technology, for some electric device such as the contactor and the circuit breaker, the coil is usually winded on the bobbin, one end of the coil is electrically connected to a first conductive metal plate, a first screw is fastened to a first conductive metal plate to form a first wiring terminal, the other end of the coil is electrically connected to a second conductive metal plate, the second screw is fastened to the second conductive metal plate to form a second wiring terminal.

When an accommodating chamber structure of the wiring terminal of the coil is assembled, the first screw is firstly screwed in the first conductive metal plate, the second screw is screwed in the second conductive metal plate, then the combination of the first screw and the first conductive metal plate and the combination of the second screw and the second conductive metal plate are inserted into the bobbin integrally. Then the first screw and the second screw are loosen to wind the coil, otherwise, the coil may kink. During detection, the first screw and the second screw need to be unscrewed and a probe is used to contact the coil to perform detection. As a result, when the accommodating chamber structure of the wiring terminal of the coil in the conventional technology is assembled, the first screw and the second screw need to be screwed and unscrewed repeatedly, which cause the assembling process is complex, and the automatic assembling may not be achieved.

In addition, to prevent dust from entering the accommodating chamber structure of the wiring terminal of the coil and to improve the level of protection, a protective cover for protecting the coil wiring terminal is usually provided on the housing after the bobbin is disposed in the housing. However, the overall structure has many plastic components, which leads to a complex structure and increased cost.

In another aspect, in the conventional technology, to improve the level of protection of the contactor, a cover is usually disposed. The cover is assembled to the housing of the contactor. Meanwhile, to improve the assistant functions of the contactor, the cover of the contactor is usually disposed with contact terminal assistant module, delay assistant module and other function assistant modules. As a result, in the conventional technology the cover is usually made hollow at corresponding positions to assemble the function assistant modules. Due to this, when the contactor is not assembled in the function assistant modules, foreign matter is easy to enter the contactor and affect the normal operation of the contactor. An additional protective cover is needed, thusly the cost is increased.

In another aspect, a contact carrier of the contactor is assembled in the housing. When the contactor is not conducted, the contact carrier is exposed out of the cover, the cover in the conventional technology is usually not provided with a protective cover for protecting the exposed part of the contact carrier, and the user may mis-operate and press the contact carrier to conduct the contactor, which damages the contactor controlling equipment and affect the personal safety.

In still another aspect, the electric device such as the contactor, the circuit breaker, the switch and thermal relay in the conventional technology are usually mounted with the help of rails. As shown in FIG. 35, which shows a rail mounting structure, a contactor base 4010 is formed with a mounting slot 4020 whose width matches the width of the rail (not shown). Each of the two sides of the mounting slot 4020 is provided with clasps 4030, and a clasping slot is formed between the clasp 4030 and the base 4010. The clasp 4030 at one side is fixedly assembled at the base 4010, and the clasp 4030 at the other side is movably assembled at the base 4010 via a spring 4040.

When the rail is assembled to the mounting slot, the rail is clasped in the clasping slot between the clasps at two sides and the base, and is fixed by the elastic force of the spring. However, the disadvantages are: firstly, the rail mounting structure is complex, thusly the manufacturing cost is high and increased; secondly, the rail mounting structure has many components, which further increases the cost.

Another rail mounting structure is provided in the conventional technology. A mounting slot is formed on the contactor base, each of the two sides of the mounting slot is provided with the clasps, and a clasping slot is formed between the clasp and the base. One clasping slot at one side is provided with a torsional spring by which elastic force is provided and the rail is fixed. However, the disadvantages are: firstly, the torsional spring principle of the rail mounting structure leads to only a single point is supported and stressed, which makes the rail shake; secondly, the rail is fixed by the elastic force of the torsional spring, which makes it unable to assemble the rail from a side, and the assembling is inconvenient.

SUMMARY

To prevent the problems in the conventional technology, according to the first aspect, the invention provides a clasping connection structure of a contactor, which makes the contactor adapt to the automatic assembling and has reduced manufacturing cost.

To achieve the problem above, the first aspect of the invention provides the technical solution of:

A clasping connection structure of a contactor, including a base, a housing and a bobbin; accommodating chambers being formed on the housing and configured to accommodate mounting contacts, the accommodating chambers being separated via a side plate, wherein, the bobbin and the housing are connected via a first clasp, the first clasp is protruded and extended at a central side plate of the housing, the central side plate is located at an axial center line of the housing, correspondingly, a limiting slot for matching with the central side plate is formed on the bobbin, the bobbin is inserted in the housing, the central side plate passes through the limiting slot, a clasp of the central side plate is hooked on the bobbin at a side of the limiting slot, to connect the bobbin and the housing, the housing and the base are connected via a second clasp.

Furthermore, the clasp of the central side plate comprises a tapered-pushing surface and a clamping stopper surface adjacently disposed with each other, the clamping stopper surface abuts against the bobbin at a side of the limiting slot.

Furthermore, the second clasp is a hook formed on the base, a clasping slot for matching with the hook is formed on the housing, and the hook is engaged in the clasping slot to connect the base and the housing.

By the solution above, the bobbin and the housing of the invention are connected via the first clasp, the housing and the base are connected via the second clasp, during the assembling, the bobbin and the housing are clasped first, and then the housing and the base are clasped. As a result the invention has the following advantages compared with the conventional technology of:

Firstly, a clasp is protruded and extended on the central side plate of the housing, the central side plate is on the axial center line of the housing, that is the side plate structure of the accommodating chamber originally existed on the housing is used, the clasp is formed on the basis of the central side plate, and thusly the design is easy, ingenious, without complex structure, as a result, the complex core-pulling and avoiding problem existed on the mould may not generate, only to form a protruding clasp by injection molding on the current central side plate. Thusly, when the housing especially the clasp of the central side plate is injection-molded, the designed mould structure is simple, the mould cost is saved and the core-pulling is easy.

Secondly, the central side plate passes through the limiting slot, the clasp of the central side plate is hooked on a bobbin at one side of the limiting slot, thusly the bobbin and the housing are connected, and one point clasp (engagement) is realized. In addition only one clasp is needed to realize the assembling of the bobbin and the housing, which is easy to assemble and easy to disassembly. During disassembling, it only needs to deflect the bobbin slightly to separate.

According to a second technical solution, an accommodating chamber structure of a wiring terminal of a coil is provided, which is adapted to the automatic assembling, reduces manufacturing cost, has concise and reliable structure, and does not need a special protective cover for covering the wiring terminal of the coil.

To achieve the object as above, the invention provides the technical solution of:

An accommodating chamber structure of wiring terminal of coil, wherein, an accommodating chamber which is opened at a side portion is provided on the bobbin, a conductive metal plate is assembled in the accommodating chamber to electrically connect with the coil, a limiting structure formed in the accommodating chamber allows the screw to be assembled at the opening of the side portion of the accommodating chamber without falling off. A through hole with IP2X level of protection is formed on the top of the accommodating chamber, the diameter of the through hole is larger than the external diameter of the head of the screw. A slot is formed at the front side wall of the accommodating chamber, so that the conductive metal plate is exposed.

Furthermore, the limiting structure is an elastic sheet integrally formed on a side wall of the accommodating chamber, the opening between the elastic sheet and the side wall is smaller than the head of the screw, and the elastic sheet elastically clamps the head of the screw.

Furthermore, an end of the elastic sheet is integrally formed with the side wall of the accommodating chamber, the elastic sheet is tapered from the inner side of the accommodating chamber to the opening of the side portion of the accommodating chamber, the other end of the elastic sheet forms an elastic clamping opening with the accommodating chamber, the other end of the elastic sheet is formed with a guiding surface, the screw enters a clamping space enclosed by the elastic sheet and the side wall of the accommodating chamber from the elastic clamping opening with the help of the guiding surface.

Furthermore, the limiting structure may also be a protrusion integrally formed on the side wall of the accommodating chamber. The opening formed between the protrusion and the side wall is smaller than the head of the screw, and the protrusion elastically clamps at the head of the screw.

Furthermore, the protrusions may be two symmetrically-disposed protrusions, and the distance between the two protrusions is smaller than the head of the screw.

Furthermore, two ribs are formed at the bottom of the accommodating chamber, the distance between the two ribs is smaller than the external diameter of the screw, and the screw is embedded in the two ribs.

Furthermore, a protective cover is integrally formed on an upper of the accommodating chamber.

Furthermore, a plurality of accommodating chambers which are opened at a side portion are formed on the bobbin, a conductive metal plate is mounted in the each accommodating chamber to electrically connect the coil, a screw is accommodated in the accommodating chamber via the side portion opening, a limiting structure is formed in the accommodating chamber to prevent the screw from falling off. A through hole with IP2X level of protection is formed on the top of the accommodating chamber, the diameter of the through hole is larger than the external diameter of the head of the screw. A slot is formed at the front side wall of the accommodating chamber, the conductive metal plate is exposed; an air insulating area is formed between the accommodating chambers.

By the solution above, during the assembling of the invention, the conductive metal plate is winded with the coil and disposed in the bobbin, then a robot is used to dispose the screw in the accommodating chamber from the side portion opening of the accommodating chamber, at that moment, the limiting structure in the accommodating chamber limits the loosening of the screw; at last the screw is fastened on the conductive metal plate to finish assembling.

In the invention, the coil is firstly winded on the conductive metal plate and then assembled to the bobbin, at that moment the screw is not needed. A limiting structure is located in the accommodating chamber, which allows the screw to be assembled from the side opening of the accommodating chamber without falling off. On the contrary, in the conventional technology, it is needed to assemble the screw on the conductive metal plate first, and then assemble it to the bobbin, otherwise, the screw may fall off. After the conductive metal plate is assembled to the bobbin, the screw is unscrewed to wind the coil, otherwise, the screw may lead to wire-kinking. After the winding is finished, the screw needs to be fastened for detection, which needs to screw or unscrew the screw repeatedly. To the wiring terminal in the invention, during the assembling, it is not needed to screw or unscrew the screw repeatedly, as a result, the invention may be assembled automatically, and the assembling process is simple, the manufacturing cost is reduced.

Meanwhile, the end of the conductive metal plate is exposed to allow the probe to directly contact the conductive metal plate for detection, and the detection is more convenient.

The screw is embedded in two ribs to prevent screw from loosing, and the protective cover is integrally formed on the top of the accommodating chamber, which makes it unnecessary to dispose the other protective cover additionally, the structure is simple and compact and the level of protection may achieve IP20.

According to a third technical solution of the invention, a cover structure of a contactor is provided, so that foreign matter and mis-operating can both be efficiently prevented when the function assistant modules are not yet assembled to the contactor, furthermore, assembling the function assistant module is easy to perform, and the contactor of the invention is cost-saving.

To achieve the object above, the technical solution of the invention is:

A cover structure of the contactor, mounted on the contactor housing. Wherein, a hollow portion is formed on the cover, the hollow portion allows a part of the contact carrier of the contactor exposed from the cover to be accommodated therein, and first protective covers which may be pried are disposed at two opposite sides of the hollow portion.

Furthermore, the pried connection between the first protective cover and the cover is: the first protective cover is connected to the cover via ribs or tearing lines.

Furthermore, the two first protective covers are co-axial and disposed in the same plane.

Furthermore, two sides of the hollow portion are further disposed with second protective covers, which may also be pried, the second protective covers are protruded and disposed on the cover, the protruding part is used to accommodate a part of the contact carrier exposed from the cover.

Furthermore, the pried connection between the second protective cover and the cover is: the second protective cover is connected to the cover via ribs or tearing lines.

Furthermore, the two first protective covers and second protective covers are co-axial.

By the solution above, two first protective covers which may be pried are disposed at two opposite sides of the hollow portion, during assembling two sets of function assistant modules, it is not needed to pry the first protective covers, and when four sets of function assistant modules are assembled, two opposite first protective covers at two sides of the hollow portion are pried to assemble the function assistant modules, to make the function assistant module operated normally.

At the same time, two opposite second protective covers which may be pried are disposed at two sides of the hollow portion, the second protective cover is protruded on the cover, and the protruding part allows the part of the contact carrier exposed from the cover to accommodate therein. Thusly when the function assistant modules are not assembled, the part of the contact carrier exposed from the cover is accommodated in the protruding part of the second protective cover, which effectively avoids human pressing on the contact carrier to make the contactor conducted and damage the contactor controlling equipment and affect personal safety. When two sets of the function assistant modules are needed, the second protective covers are pried to form assembling portions to assemble, when four sets of function assistant modules are needed to assemble, two sets of first protective covers are pried in addition to the two second protective covers, the assembling is convenient and the cost is saved.

According to the fourth technical solution of the invention, a rail mounting structure of an electric device is provided to make it have the simple structure and reduced the manufacturing cost, and the rail is assembled stably, and is adapted to the automatic assembling.

To achieve the object above, the technical solution of the invention is:

A rail mounting structure of an electric device, wherein, an mounting slot is formed on the base of the electric device, at least one first fixing clasp is formed on one side of the mounting slot, a first clasping slot is formed between the first fixing clasp and the base; a second fixing clasp is formed at the other side of the mounting slot, a second clasping slot is formed between the second fixing clasp and the base; a first limiting block and a second limiting block are formed at two sides of the second fixing clasp, respectively, a first limiting slot is formed between the first limiting block and the base, and a second limiting slot is formed between the second limiting block and the base. The first limiting slot and the second limiting slot are arc-shaped limiting slots, two ends of a snap spring are arc-shaped and disposed in the first limiting slot and the second limiting slot, respectively, and form linear contact with the side walls of the first limiting slot and the second limiting slot, the middle stage of the snap spring is in the second clasping slot.

Furthermore, ribs are formed on the side walls of the first limiting slot and second limiting slot, and disposed above the snap spring.

Furthermore, the width of the second clasping slot becomes wider gradually from inner part to the inserting opening of the snap spring.

Furthermore, tapered guiding surfaces are formed respectively on the first limiting block and a second limiting block.

Furthermore, the second fixing clasp, the first limiting block and the second limiting block are disposed as a reverse-trapezoid shape, correspondingly, the snap spring is a reverse-trapezoid shape with a top opening, and the middle stage thereof is straight or curved stage.

Furthermore, the first limiting block and the second limiting block are formed by two parallel half-cylinders, and tapered surfaces are formed on each of the half-cylinders, respectively.

By the solution above, when the electric device is mounted via the rail, one side of the rail is disposed in the first clasping slot, the other side is disposed in the second clasping slot, the rail elastically contacts to the middle stage of the snap spring to deform the snap spring elastically, two ends of the snap spring abut against the base, the first limiting slot and the second limiting slot are arc-shaped limiting slots, two ends of the snap spring are arc-shaped and located in the first limiting slot and the second limiting slot, and have linear contact with the side walls of the first limiting slot and the second limiting slot, which has the advantages of:

Firstly, two ends of the snap spring linearly contact with the side walls of the first limiting slot and the second limiting slot, which make the snap structure mount stable and not easy to fall off.

Secondly, the leaf spring principle of the snap spring makes the rail mount stably.

Thirdly, the snap spring is used to allow the rail to be mounted from the side, which is easy to assemble.

Fourth, only a snap spring is needed to mount the device to the rail, the manufacturing and usage cost thereof can be reduced.

During assembling the snap spring, firstly the snap spring is disposed in the mounting slot, the middle stage of the snap spring is located opposite to the second fixing clasp, two ends of the snap spring correspond to the first limiting block and the second limiting block; the snap spring is moved to get close to the second fixing clasp, to make the middle stage of the snap spring in the second clasping slot, two ends of the snap spring slide into the first limiting slot and the second limiting slot via the tapered guiding surface, the assembling process have no structure block, thusly it can achieve the automatic assembling and save manufacturing cost.

The ribs are formed on the side walls of the first limiting slot and the second limiting slot, the ribs are disposed on the snap spring to prevent two ends of the snap spring from warping under pressure, thusly prevent the falling off of the snap spring. At the same time, the width of the second clasping slot becomes wider gradually from inner part to the inserting opening of the snap spring, which effectively avoids falling off of the snap spring due to warping of the middle stage of the snap spring under pressure.

BRIEF DESCRIPTION OF THE DRAWINGS

The accompanying drawings are used to provide a further understanding of the invention, which are incorporated in and constitute a part of this application, illustrate embodiments of the present invention together with the description serve to explain the principles of the invention.

In the Figures.

REFERENCE NUMERALS

Figure 1:
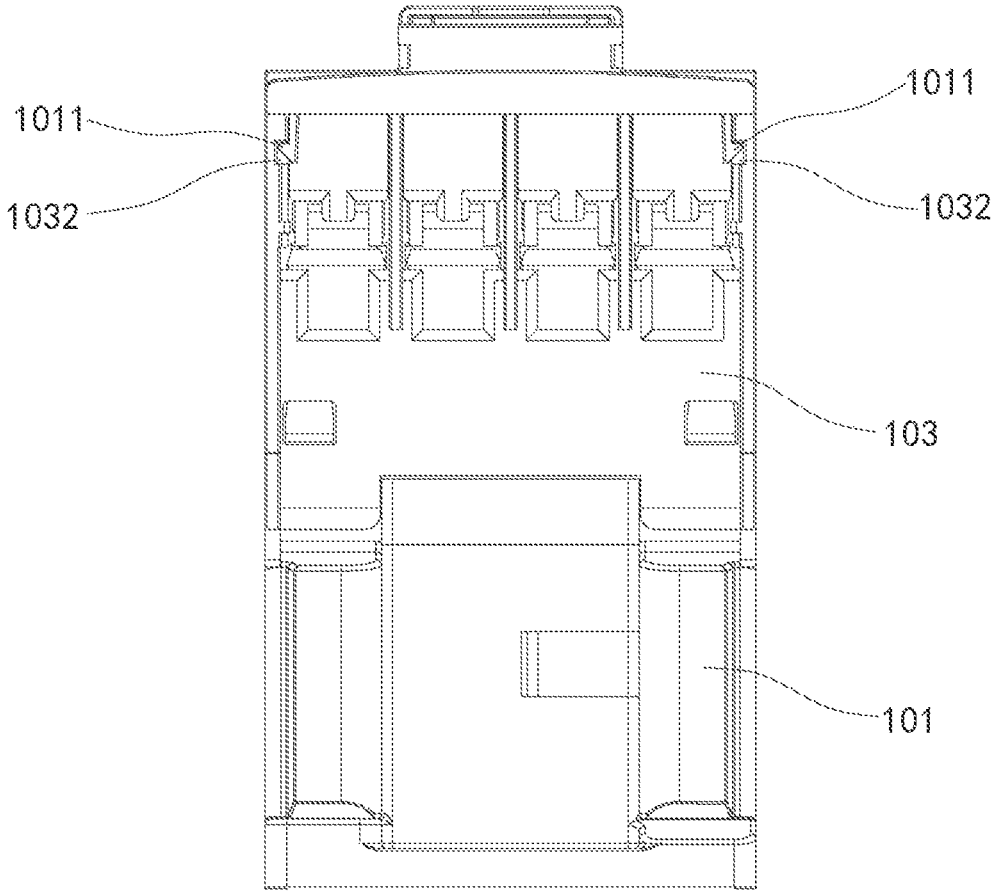
FIG. 1 is a sectional view of the invention.

| | |
|---|---|
| base 101 | hook 1011 |
| bobbin 102 | limiting slot 1021 |
| housing 103 | accommodating chamber 1030 |
| side plate 1031 | |
| clasp 10311 | tapered-pushing surface 103111 |
| clamping stopper surface 103112 | clasping slot 1032 |
| first clasp 104 | second clasp 105 |
| bobbin 2010 | first accommodating chamber 201 |

-continued

| | |
|---|---|
| opening 2011 | limiting structure 2012 |
| elastic sheet 20121 | protrusion 20122 |
| through hole 2013 | slot 2014 |
| rib 2015 | second accommodating chamber 202 |
| through hole 2021 | slot 2022 |
| first conductive metal plate 203 | second conductive metal plate 204 |
| first screw 205 | second screw 206 |
| protective cover 207 | air insulating area 208 |
| housing 3010 | function assistant module 3020 |
| cover 301 | hollow portion 3011 |
| first protective cover 3012 | second protective cover 3013 |
| base 4010 | mounting slot 4020 |
| clasp 4030 | spring 4040 |
| electric device 40100 | |
| base 401 | mounting slot 4011 |
| first fixing clasp 4012 | first clasping slot 4013 |
| second fixing clasp 4014 | second clasping slot 4015 |
| first limiting block 4016 | second limiting block 4017 |
| tapered guiding surface (40161, 40171) | first limiting slot 4018 |
| second limiting slot 4019 | snap spring 402 |
| rail 403 | |

DETAILED DESCRIPTION

Hereinafter, the embodiments of the present disclosure will be described in detail in conjunction with the drawings.

Technical Solution 1

As shown from FIG. 1 to FIG. 8, the invention discloses a clasping connection structure of a contactor, including a base 101, a bobbin 102 and a housing 103. A plurality of accommodating chambers 1030 are formed on the housing for assembling contact head. The accommodating chambers 1030 are separated by a side plate 1031, as shown in FIG. 3*c*.

Figure 2:
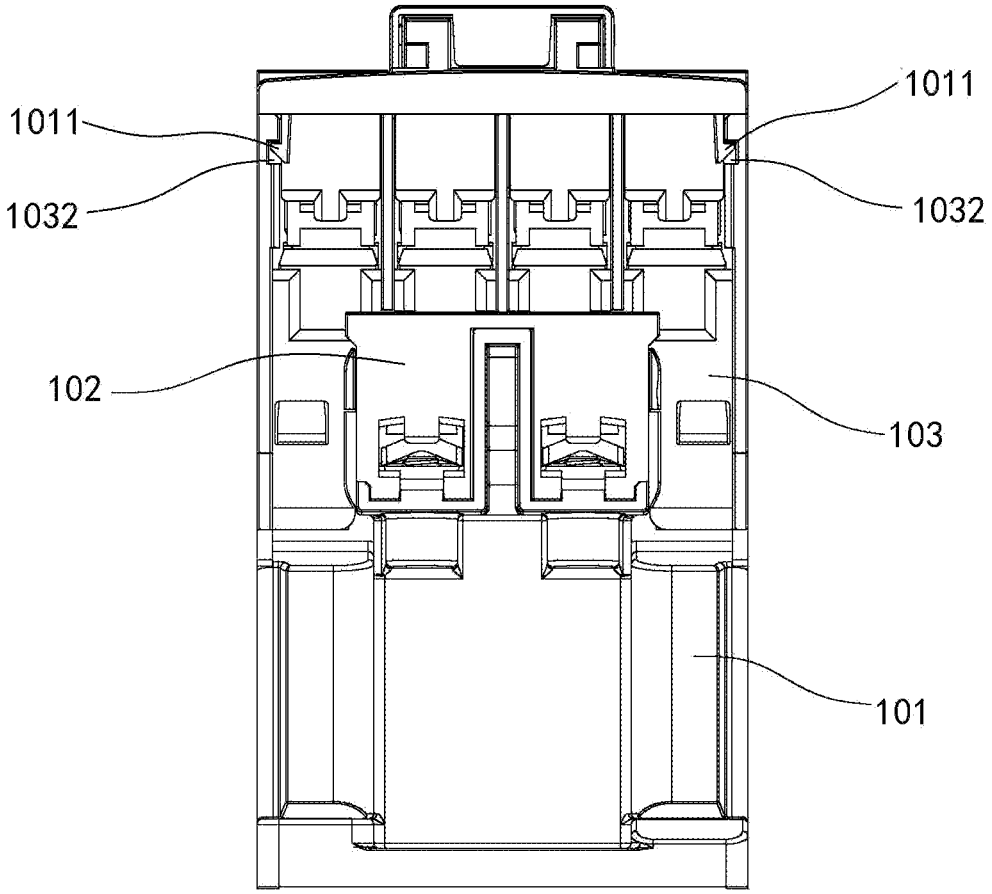
FIG. 2 is a sectional view of the invention in another point of view.
Figure 3A:
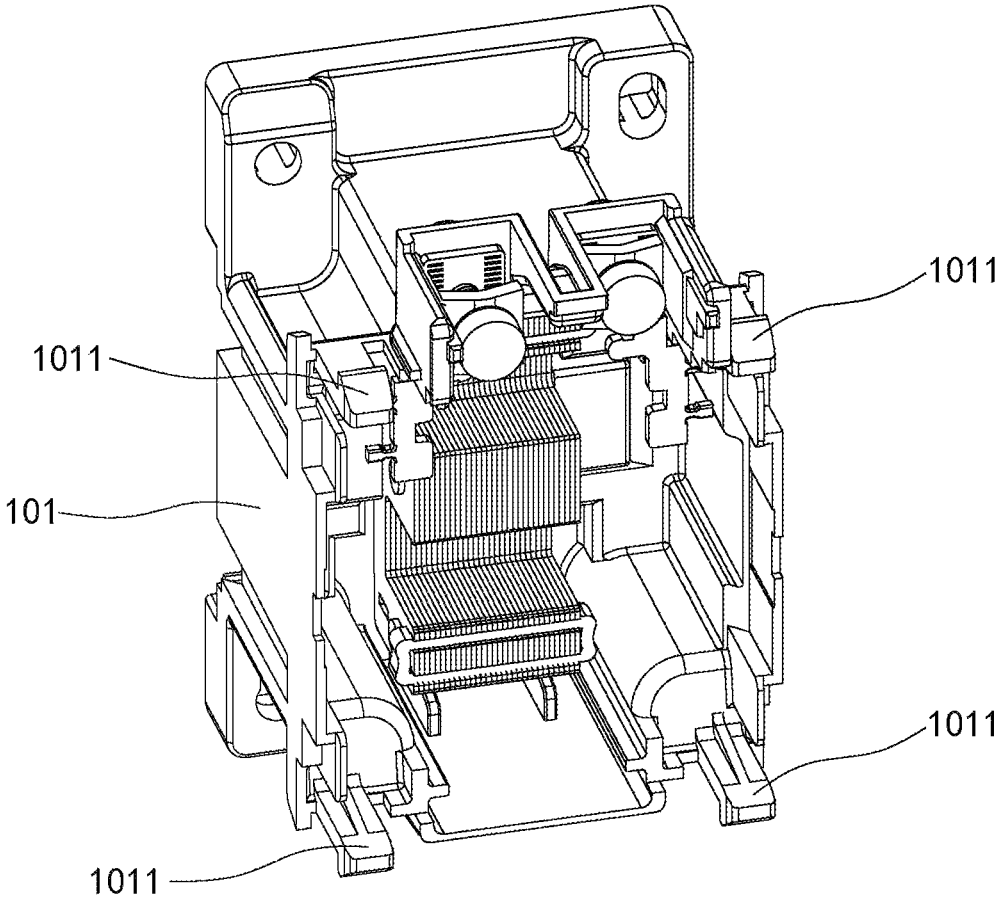
FIG. 3*a* is schematic view showing the structure of the base of the invention.
Figure 3B:
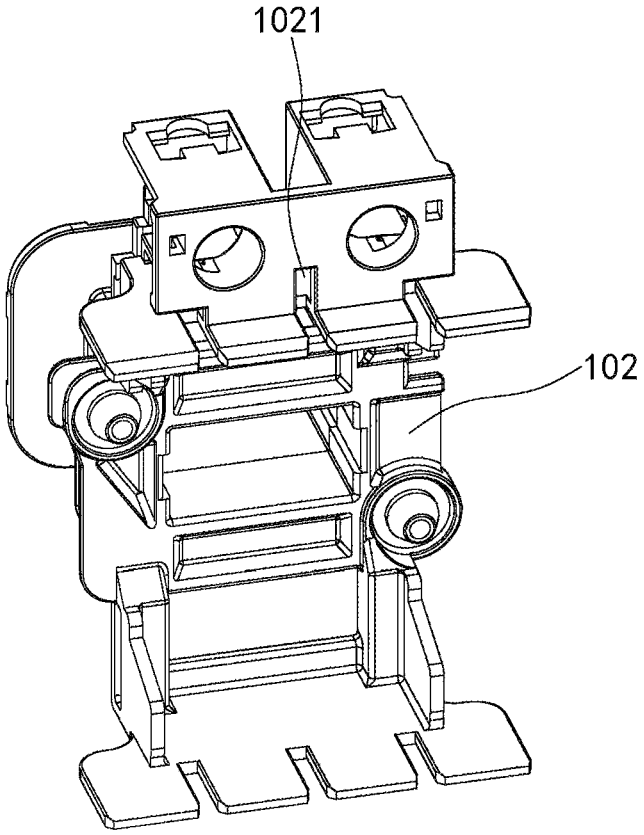
FIG. 3*b* is schematic view showing the structure of the bobbin of the invention.
Figure 3C:
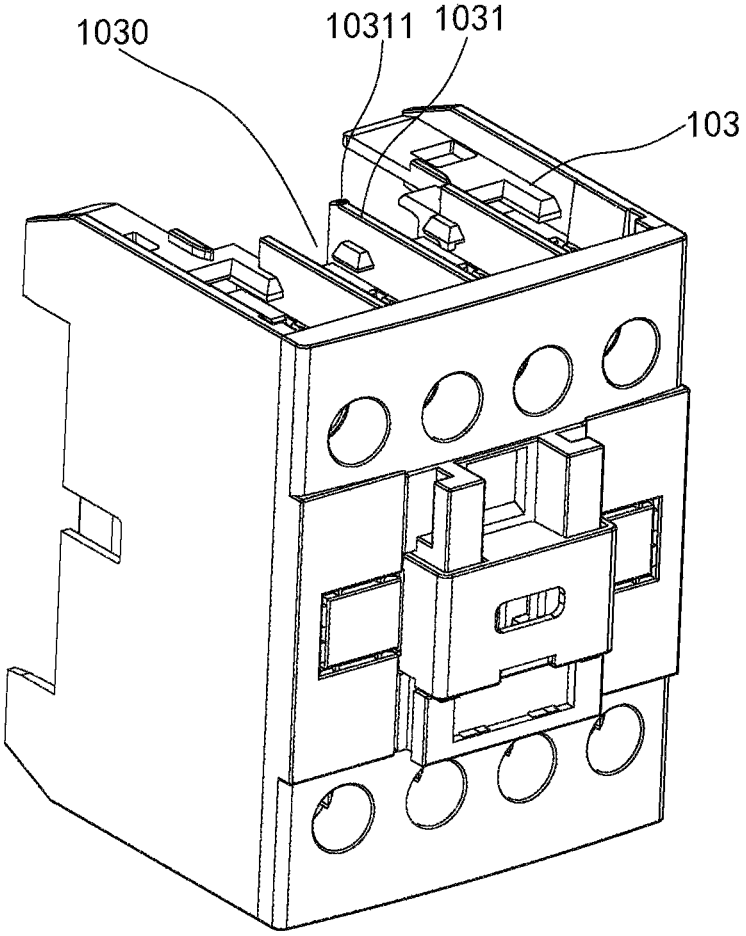
FIG. 3*c* is schematic view showing the structure of the housing of the invention.
Figure 4:
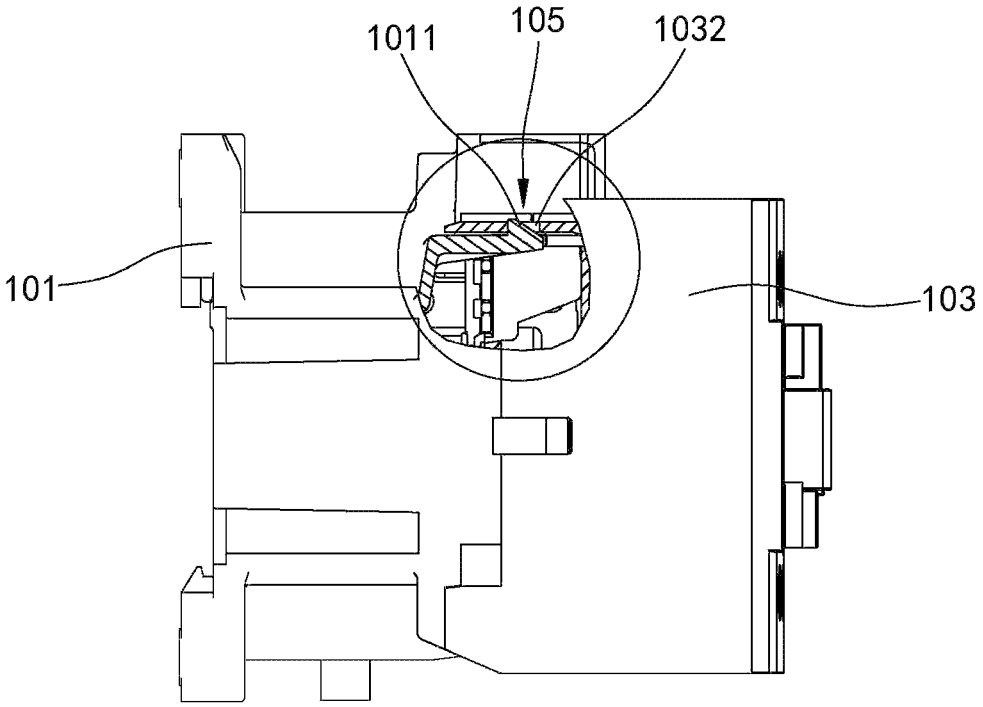
FIG. 4 is a partial sectional view of the invention.
Figure 5:
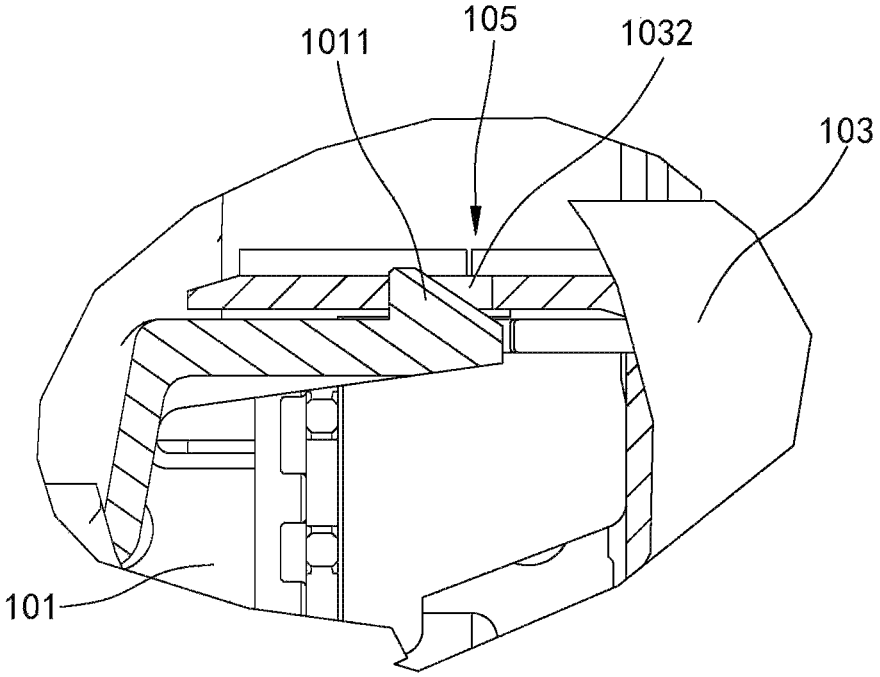
FIG. 5 is a partial enlarged view of FIG. 4.
Figure 6:
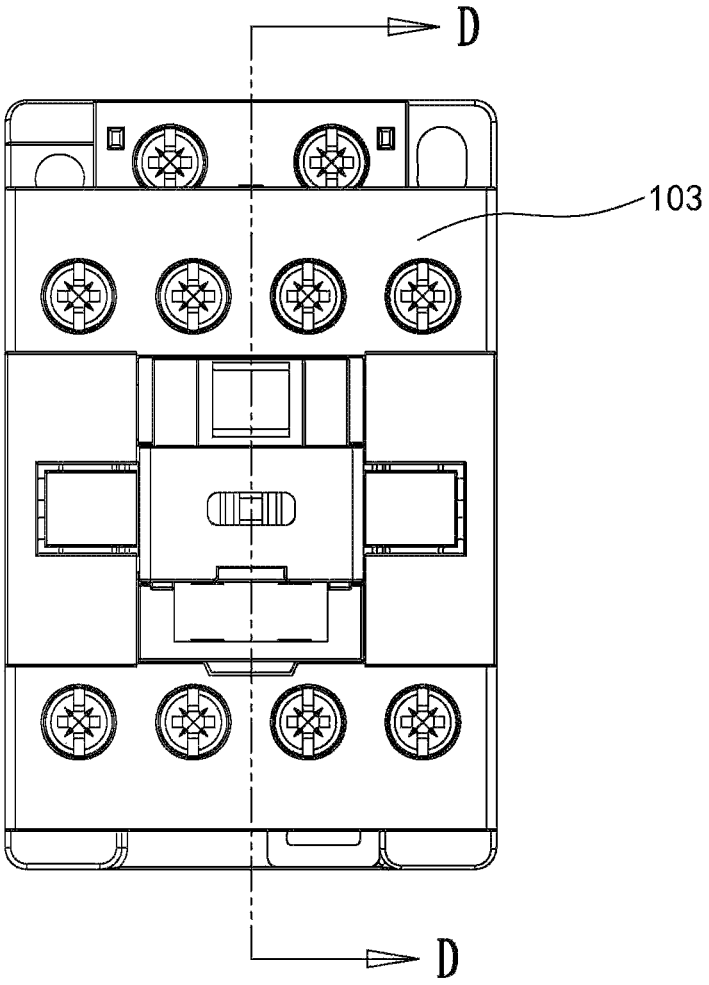
FIG. 6 is a top view of the invention.
Figure 7:
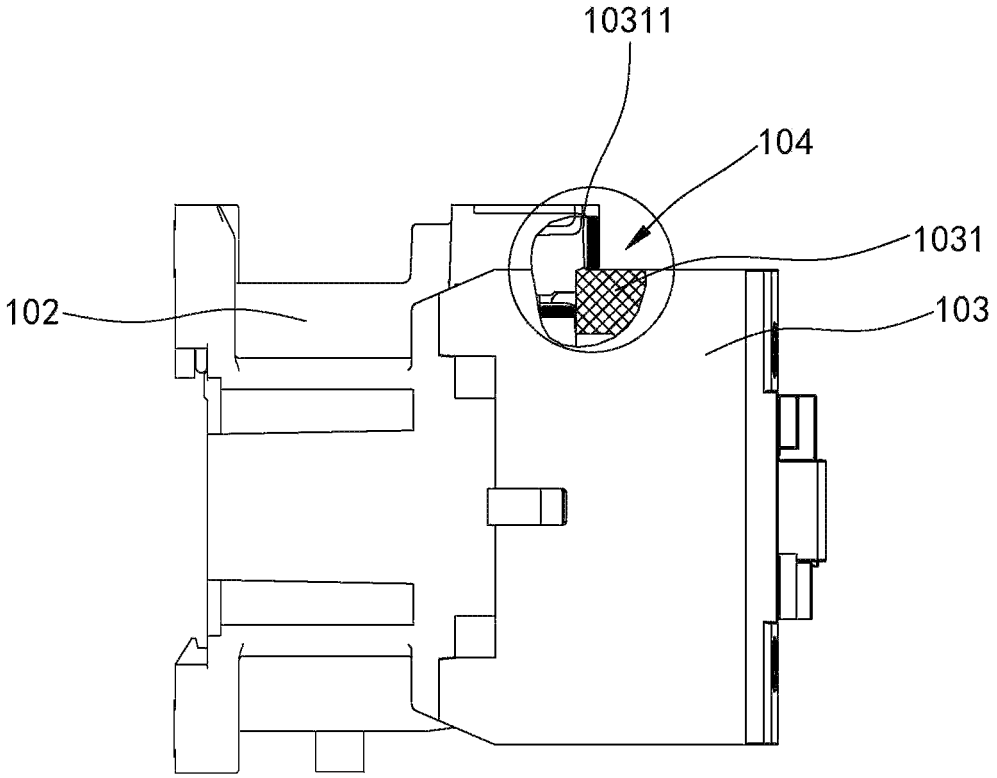
FIG. 7 is a D-D sectional view of FIG. 6.
Figure 8:
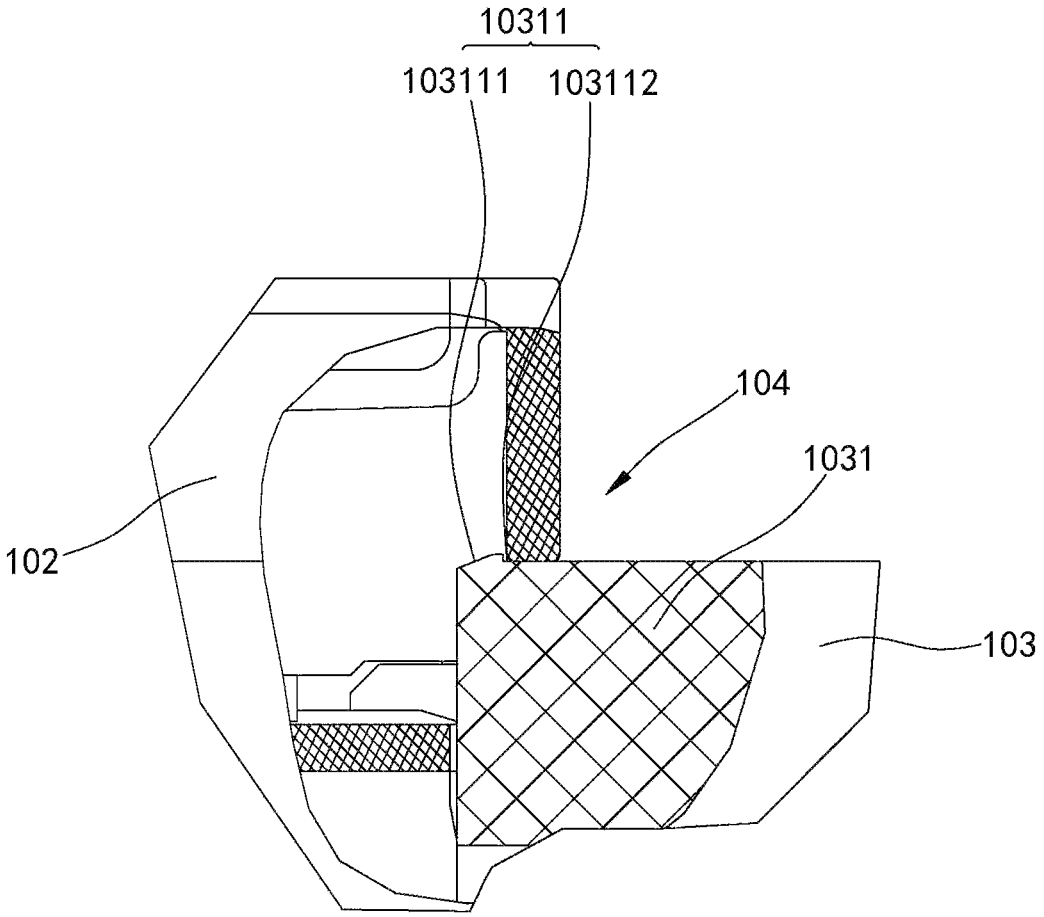
FIG. 8 is a partial enlarged view of FIG. 7.
Figure 9A:
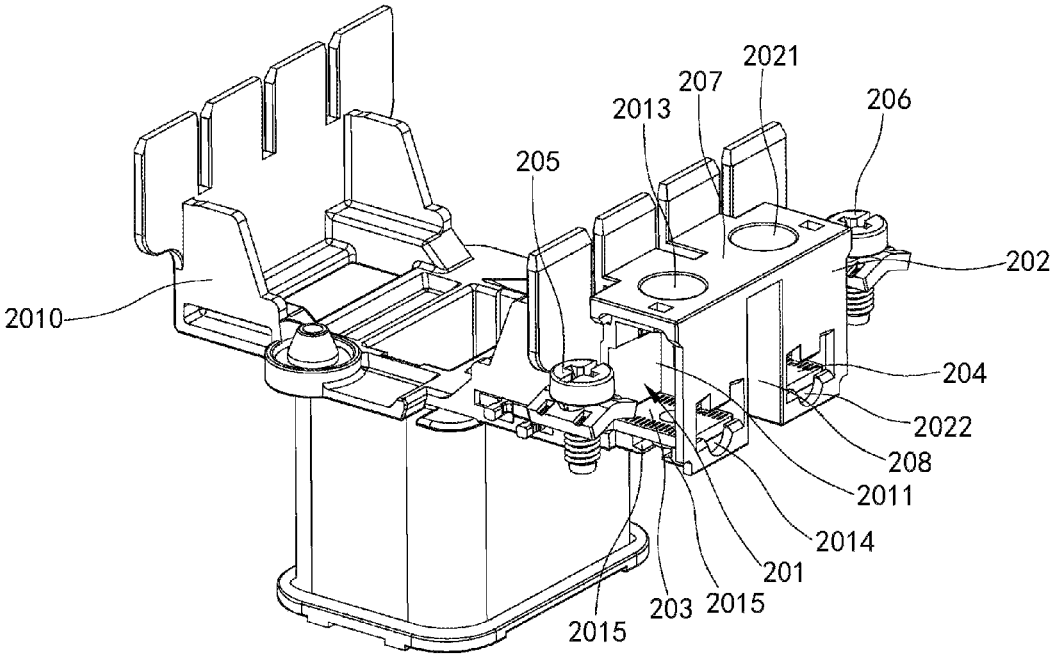
FIG. 9*a* is a schematic view showing the structure of the invention before screw is assembled.
Figure 9B:
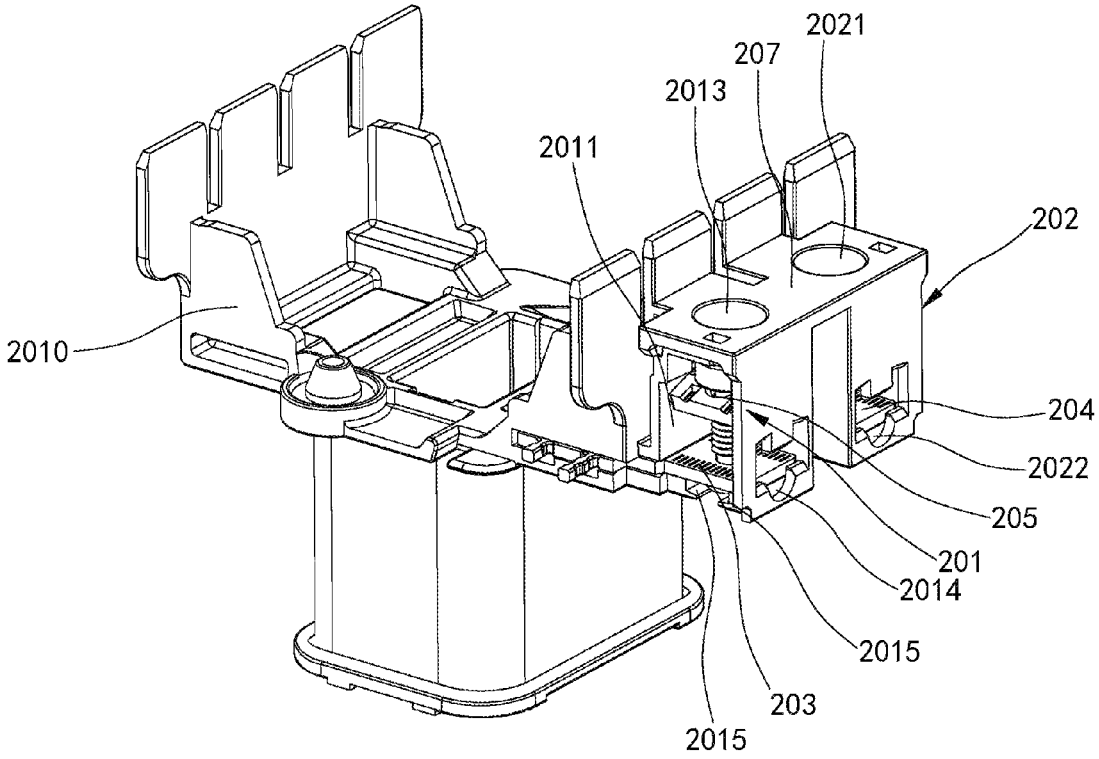
FIG. 9*b* is a schematic view showing the structure of the invention after screw is assembled.
Figure 10:
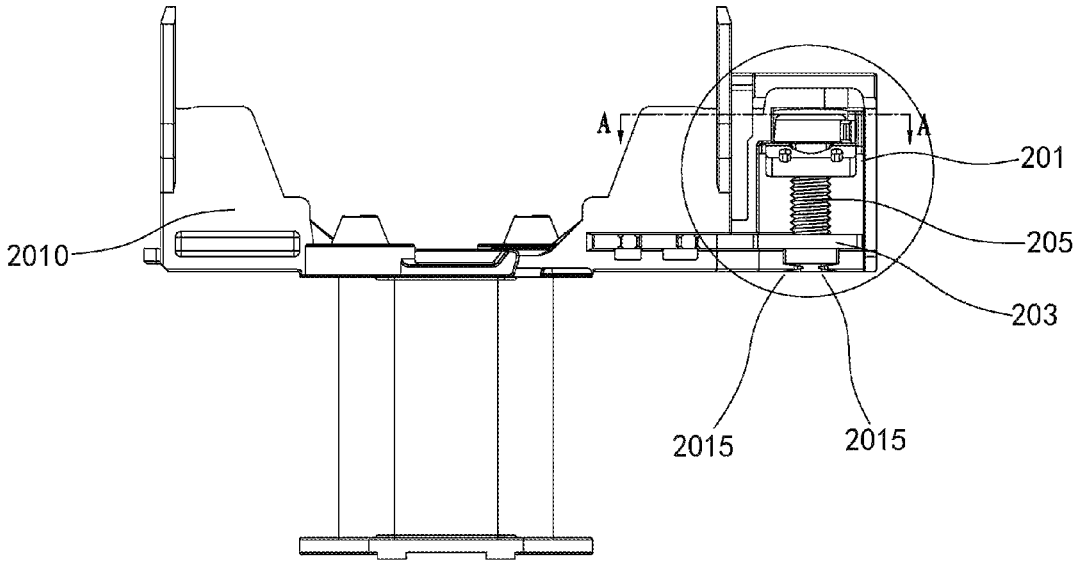
FIG. 10 is a sectional view of the invention.

As shown in FIG. 7 and FIG. 8, the bobbin 102 is connected to the housing 103 via a first clasp 104, as shown in FIG. 4 and FIG. 5 accompanying with FIG. 3*b* and FIG. 3*c*, the first clasp 104 is connected to form an clasp 10311 which is protruded and extended from the central side plate 1031 of the housing 103. The central side plate 1031 is located on an axial center line of the housing 103, and the clasp 10311 is formed at the end of the central side plate 1031. Correspondingly, as shown in FIG. 3*b*, the bobbin 102 is provided with a limiting slot 1021 matching with the first central side plate 1031, the bobbin 102 is inserted into the housing 103, the central side plate 1031 passes through the limiting slot 1021, the clasp 10311 of the central side plate 1031 is hooked on a bobbin 102 at one side of the limiting slot 1021, as shown in FIG. 7 and FIG. 8, to connect the bobbin 102 and the housing 103, The housing 103 and the base 101 are connected via a second clasp 105. The second clasp 105 includes a hook 1011 formed on the base 101, as shown in FIG. 3*a*, there are four hooks 1011 in the embodiment, and four clasping slots 1032 are formed on the housing 103 to match the hooks 1011, as shown in FIG. 4 and FIG. 5, the hooks 1011 are engaged in the clasping slots 1032 to connect the base 101 and the housing 103, as shown in FIG. 1 and FIG. 2.

A clasp 10311 is protruded and extended from the central side plate 1031 of the housing 103. That is, the structure of the side plate 1031 of the accommodating chamber 1030 originally existed on the housing 103 is used to form the clasp 10311 on the basis of the central side plate 1031, the design is easy, ingenious, without complex structure, as a result, the complex core-pulling and avoiding problem existed on conventional mould may not generate, but only to form a protruding clasp 10311 by injection molding on the current central side plate 1031. Thusly, when the housing 103 especially the clasp 10311 of the central side plate 1031 is injection-molded, the designed mould structure is simple, the mould cost is saved and the core-pulling is easy.

Besides, the central side plate 1031 passes through the limiting slot 1021, the clasp 10311 of the central side plate 1031 is hooked on a bobbin 102 at one side of the limiting slot 1021, thusly the bobbin 102 and the housing 103 are connected, and thusly one point engagement (clasp 10311) is realized. Only the clasp 10311 is needed to realize the assembling of the bobbin 102 and the housing 103, to make the bobbin 102 and the housing 103 easy to assemble and easy to detach. During detaching, it only needs to deflect the bobbin 102 slightly to disengage.

The clasp 10311 includes a tapered-pushing surface 103111 and a clamping stopper surface 103112 adjacent with each other, the clamping stopper surface 103112 abuts against the outer side wall of the first limiting slot 1021.

During assembling, the bobbin 102 and the housing 103 are engaged first, and then the housing 103 and the base 101 are engaged without the need of screw fastening, which is adapted to the automatic assembling, reduces assembling cost, and reduces the screw cost and human cost.

The Second Technical Solution

Hereinafter the invention is illustrated accompanying with FIG. 9*a* to FIG. 17.

As shown from FIG. 9*a* to FIG. 13, in the invention the contactor is taken as an example to disclose an accommodating chamber structure of wiring terminal of the coil, a first accommodating chamber 201 and a second accommodating chamber 202 are formed on the bobbin 2010.

The first conductive metal plate 203 is assembled in the first accommodating chamber 201 and is electrically connected to an end of the coil, a side portion of the first accommodating chamber 201 is provided with an opening 2011, the first screw 205 is disposed in the first accommodating chamber 201 via the opening 2011, the side wall of the first accommodating chamber 201 is formed with a limiting structure 2012 for limiting the looseness of the first screw 205. As shown in FIG. 11*b*, the top of the first accommodating chamber 201 is provided with a through hole 2013 corresponding to the head of the first screw 205. A slot 2014 is formed at a side portion of the first accommodating chamber 201 corresponding to an end of the first conductive metal plate 203. The end of the first conductive metal plate 203 is exposed, and thusly a probe may directly contact the first conductive metal plate 203 during the detection, which makes detection more convenient.

Figure 11A:
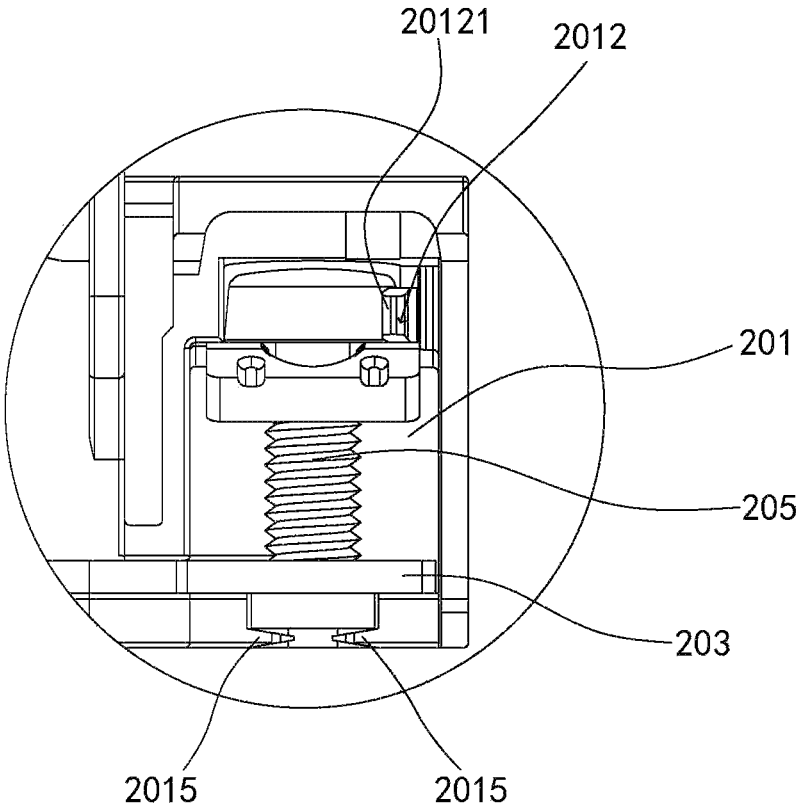
FIG. 11*a* is a partial enlarged view of FIG. 10.
Figure 11B:
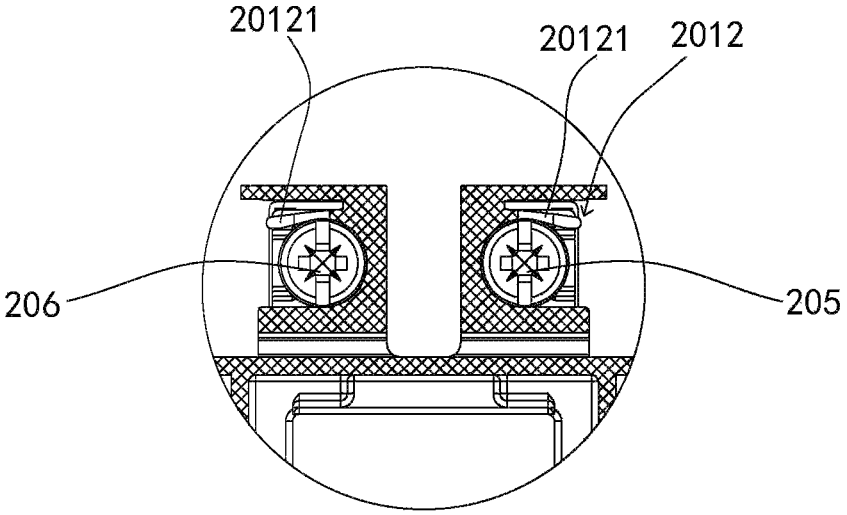
FIG. 11*b* is an A-A directional view of FIG. 10.

In the embodiment, as shown in FIG. 11*a* and FIG. 11*b*, the limiting structure 2012 is preferable an elastic sheet 20121 integrally formed on a side wall of the first accommodating chamber 201, the opening between the elastic sheet 20121 and the side wall is smaller than the head of the first screw 205, the elastic sheet 20121 elastically clamps the head of the first screw 205, the elastic sheet 20121 is plastic sheet with elastic.

An end of the elastic sheet 20121 is integrally formed with the side wall of the first accommodating chamber 201, the elastic sheet 20121 is tapered from the inner side of the first accommodating chamber 201 to the opening 2011 of the side portion of the first accommodating chamber 201, the other end of the elastic sheet 20121 forms an elastic clamping opening together with the first accommodating chamber 201, the other end of the elastic sheet 20121 is formed with a guiding surface, the first screw 205 enters the clamping space enclosed by the elastic sheet 20121 and the side wall of the first accommodating chamber 201 from the elastic clamping opening with the help of the guiding surface. The elastic sheet 20121 facilitates the first screw 205 to enter the clamping space enclosed by the elastic sheet 20121 and the side wall of the first accommodating chamber 201, and at the same time facilitates the taking out of the first screw 205, as shown in FIG. 11*a* to FIG. 11*c*.

Figure 15:
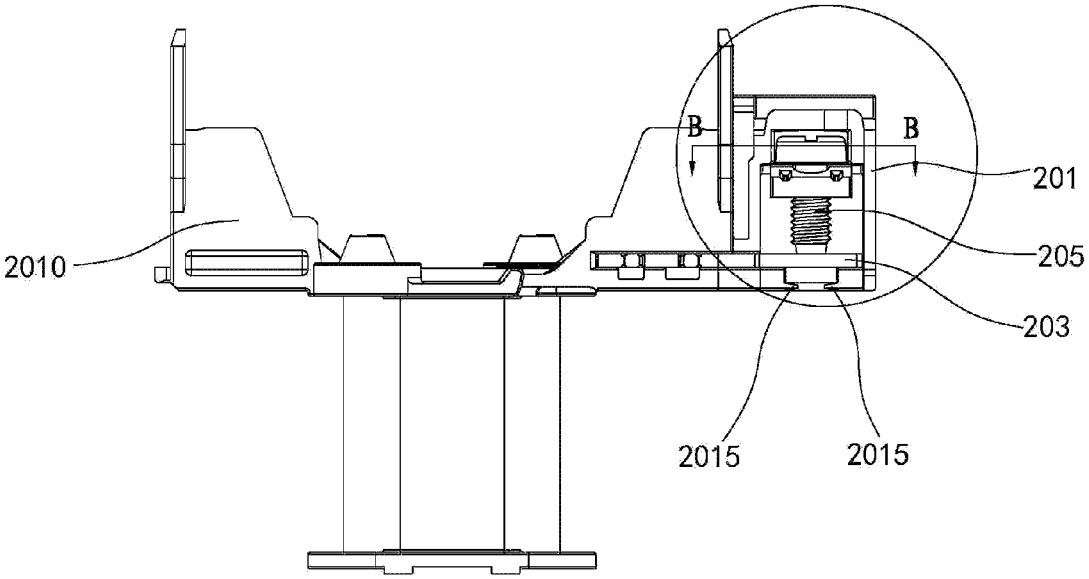
FIG. 15 is a schematic view showing another structure of the limiting structure in the invention.
Figure 16:
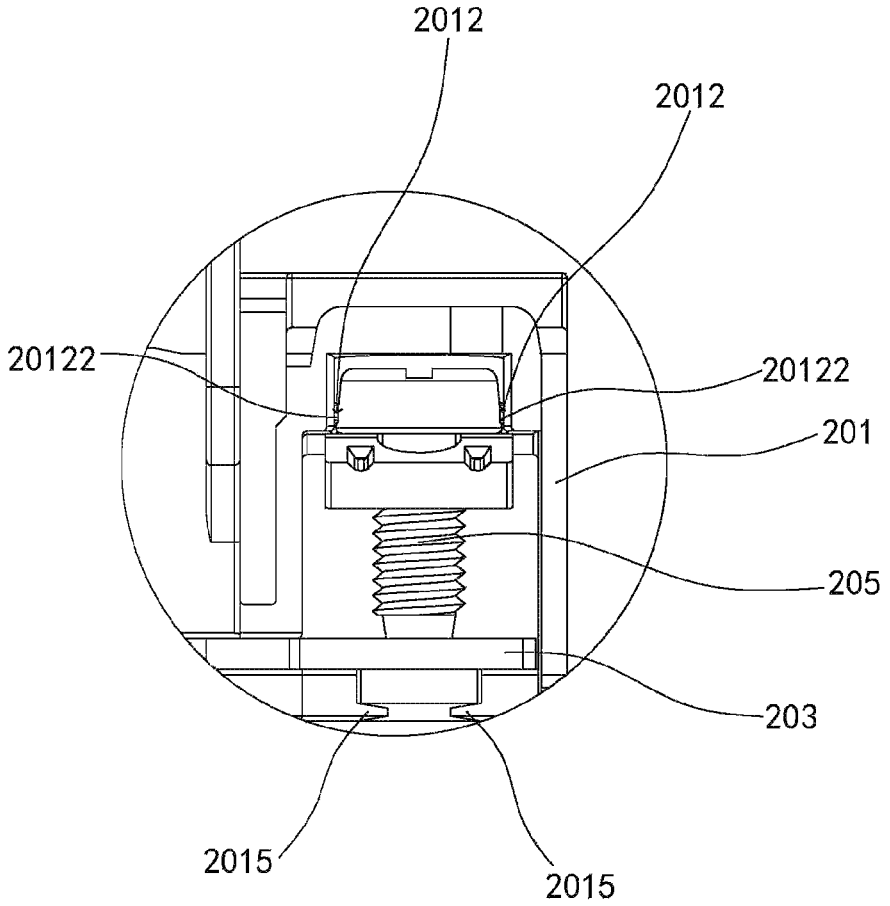
FIG. 16 is a partial enlarged view of FIG. 15.
Figure 17:
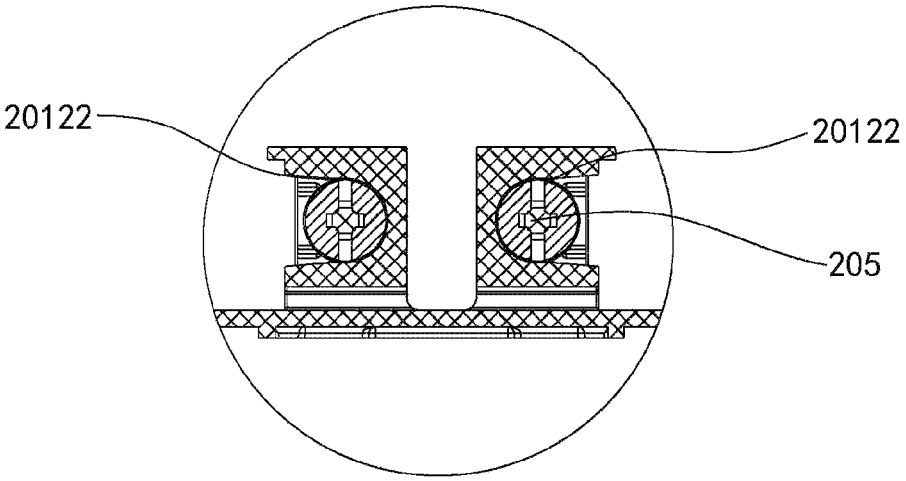
FIG. 17 is a B-B sectional view of FIG. 15.

As shown from FIG. 15 to FIG. 17, the limiting structure 2012 may also be a protrusion 20122 integrally formed on the side wall of the first accommodating chamber 201. The opening formed between the protrusion 20122 and the side wall is smaller than the head of the first screw 205, and the protrusion 20122 elastically clamps at the head of the first screw 205.

The protrusions 20122 may be two symmetrically-disposed protrusions, the distance between the two protrusions 20122 is smaller than the head of the first screw 205.

Figure 12:
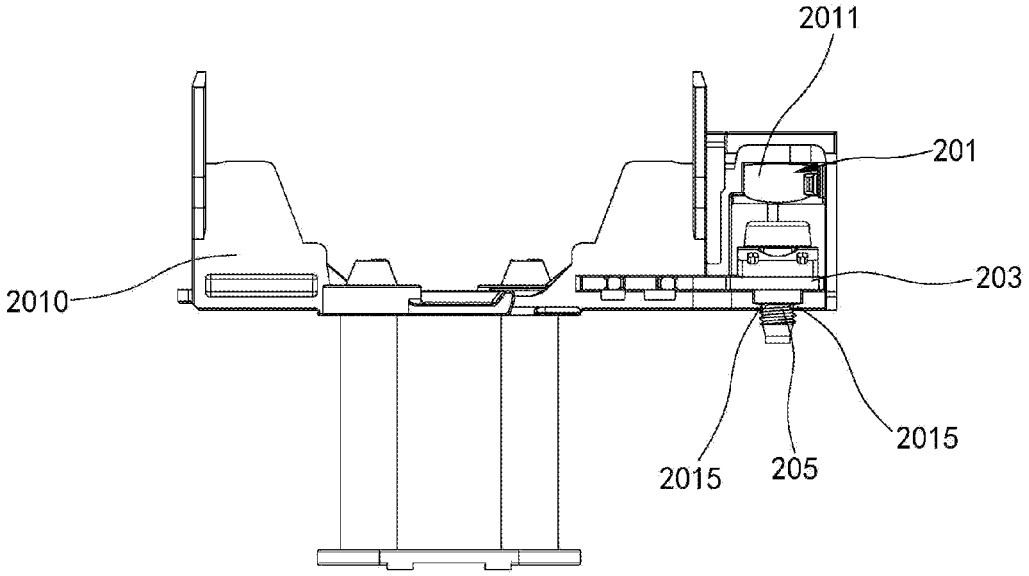
FIG. 12 is another sectional view of the invention.
Figure 13:
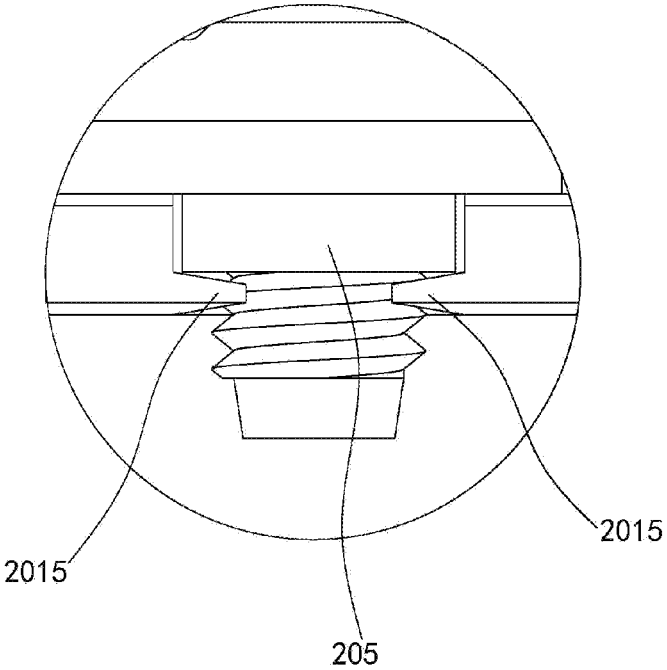
FIG. 13 is a partial enlarged view of FIG. 12.
Figure 14A:
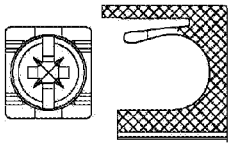
FIG. 14*a* is a first schematic view showing assembling the screw.
Figure 14B:
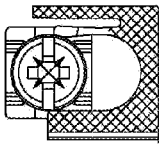
FIG. 14*b* is a second schematic view showing assembling the screw.
Figure 14C:
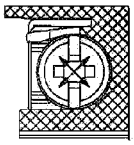
FIG. 14*c* is a third schematic view showing assembling the screw.

As shown in FIG. 12 and FIG. 13, in the embodiment, two ribs 2015 are formed at the bottom of the first accommodating chamber 201, the distance between the two ribs 2015 is smaller than the external diameter of the first screw 205, the first screw 205 is embedded in the two ribs 2015 to avoid looseness of the first screw 205.

The second accommodating chamber 202 has the same structure as that of the first accommodating chamber 201, the second conductive metal plate 204 is assembled at the second accommodating chamber 202, and electrically connected to the other end of the coil, a side portion of the second accommodating chamber 202 has an opening (not shown), the second screw 206 is disposed in the second accommodating chamber 202 via the opening, the side wall of the second accommodating chamber 202 is provided with limiting structure 2012 for limiting the looseness of the second screw 206, the top of the second accommodating chamber 202 is formed with a through hole 2021 corresponding to the head of the second screw 206. A slot 2022 is formed at the side portion of the second accommodating chamber 202 corresponding to an end of the second conductive metal plate 204, the end of the second conductive metal plate 204 is exposed, and thusly a probe may directly contact the second conductive metal plate 204 during the detection, which makes the detection more convenient.

In the embodiment, as shown in FIG. 11*a* and FIG. 11*b*, the limiting structure 2012 is preferably an elastic sheet 20121 integrally formed on a side wall of the second accommodating chamber 202, the opening between the elastic sheet 20121 and the side wall is smaller than the head of the second screw 206, the elastic sheet 20121 elastically clamps the head of the second screw 206, the elastic sheet 20121 is plastic sheet with elastic. The elastic sheet 20121 in the second accommodating chamber 202 and the elastic sheet 20121 in the first accommodating chamber 201 are disposed in the same manner, which is not illustrated for concise purpose.

As shown in FIG. 15 and FIG. 17, the limiting structure 2012 may also be a protrusion 20122 which is elastic and integrally formed at the side wall of the second accommodating chamber 202. The opening formed between the protrusion 20122 and the side wall is smaller than the head of the second screw 206, and the protrusion 20122 elastically clamps at the head of the second screw 206.

The protrusions 20122 may be two symmetrically-disposed protrusions, the distance between the two protrusions 20122 is smaller than the head of the second screw 206.

Similarly, two ribs 2015 are formed at the bottom of the second accommodating chamber 202, the distance between the two ribs 2015 is smaller than the external diameter of the second screw 206, and the second screw 206 is embedded in the two ribs 2015 to avoid looseness of the second screw 206.

A protective cover 207 is integrally formed on the top of the first accommodating chamber 201 and the second accommodating chamber 202, and thusly the protective cover does not need to be disposed additionally, the structure is easy and compact, and the level of protection may achieve IP20.

An air insulating area 208 is disposed between the first accommodating chamber 201 and the second accommodating chamber 202, thusly the electric clearance and the creep distance between the first screw 205 and the second screw 206 are enough, and thusly a large enough recess is located between the first accommodating chamber 201 and the second accommodating chamber 202, and the large enough electric clearance and creep distance are ensured.

The contactor is taken as an example in the above to illustrate the wiring terminal structure, and the wiring terminal structure may be used in other electric device such as the circuit breaker or the switch.

The Third Technical Solution:

Hereinafter the detail embodiment is illustrated accompanying with FIG. 18 to FIG. 29.

Figure 18:
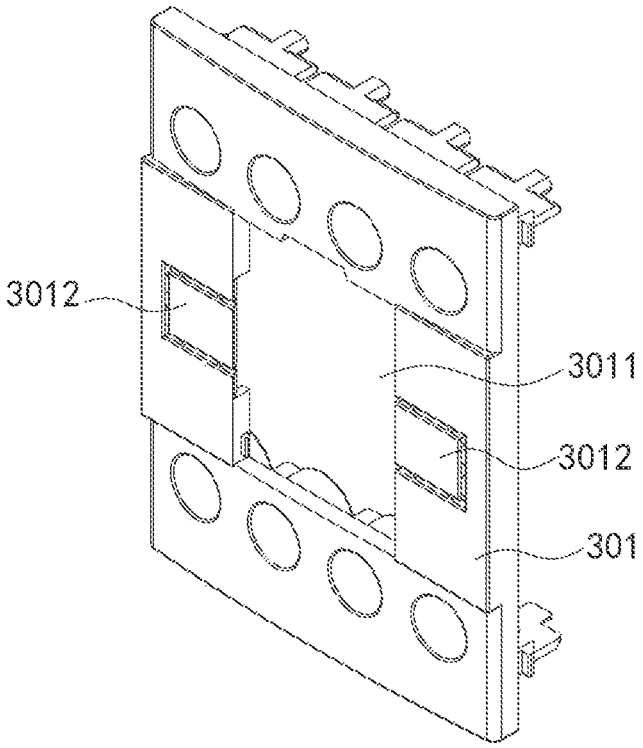
FIG. 18 is a schematic view showing the structure of the invention before second protective cover is assembled.
Figure 19:
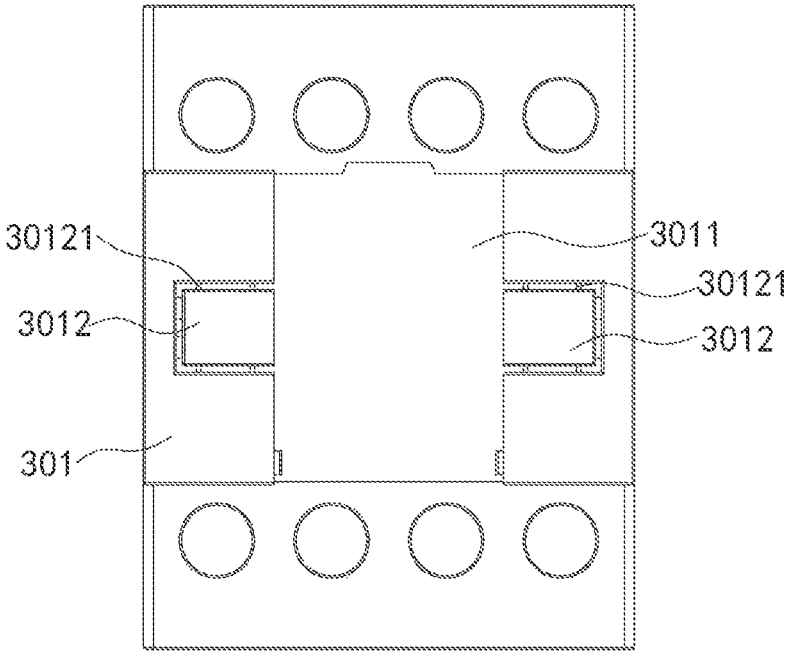
FIG. 19 is a top view of the invention without the second protective cover.
Figure 21:
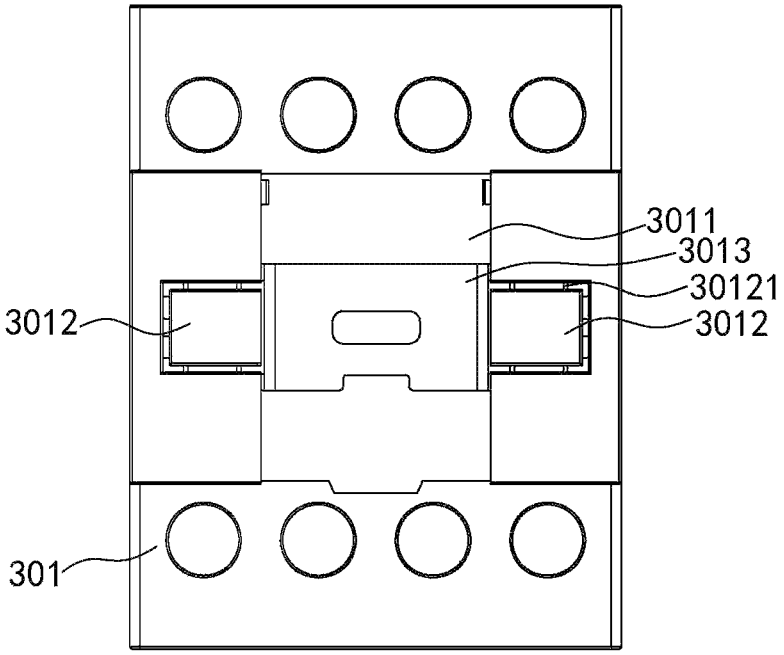
FIG. 21 is a top view of the invention with the second protective cover assembled.
Figure 22:
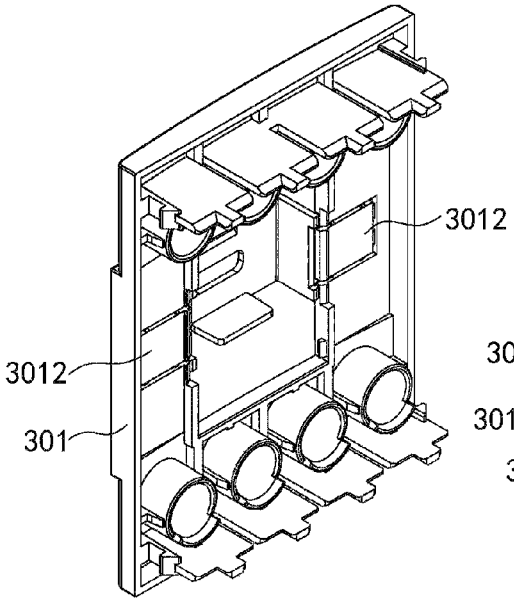
FIG. 22 is a schematic view of the invention when the second protective cover is disposed from another point of view.
Figure 23:
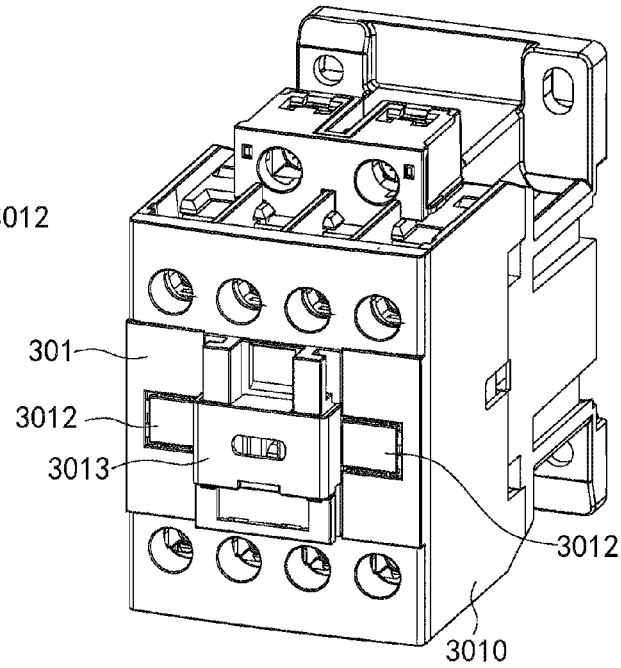
FIG. 23 is a schematic view showing the invention assembled to the contactor when the second protective cover is assembled.
Figure 24:
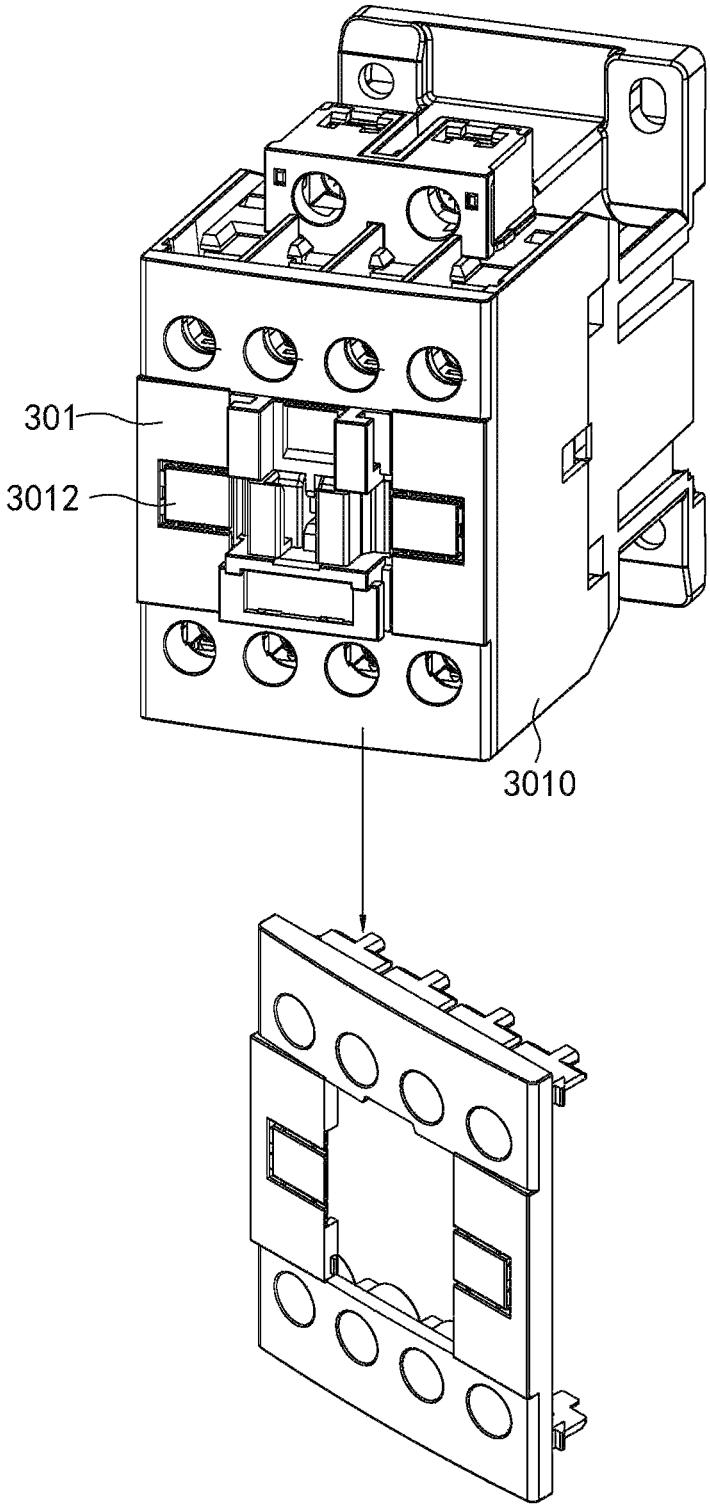
FIG. 24 is a schematic view showing the state that the second protective covers are pried when two sets of function assistant modules are assembled.
Figure 25:
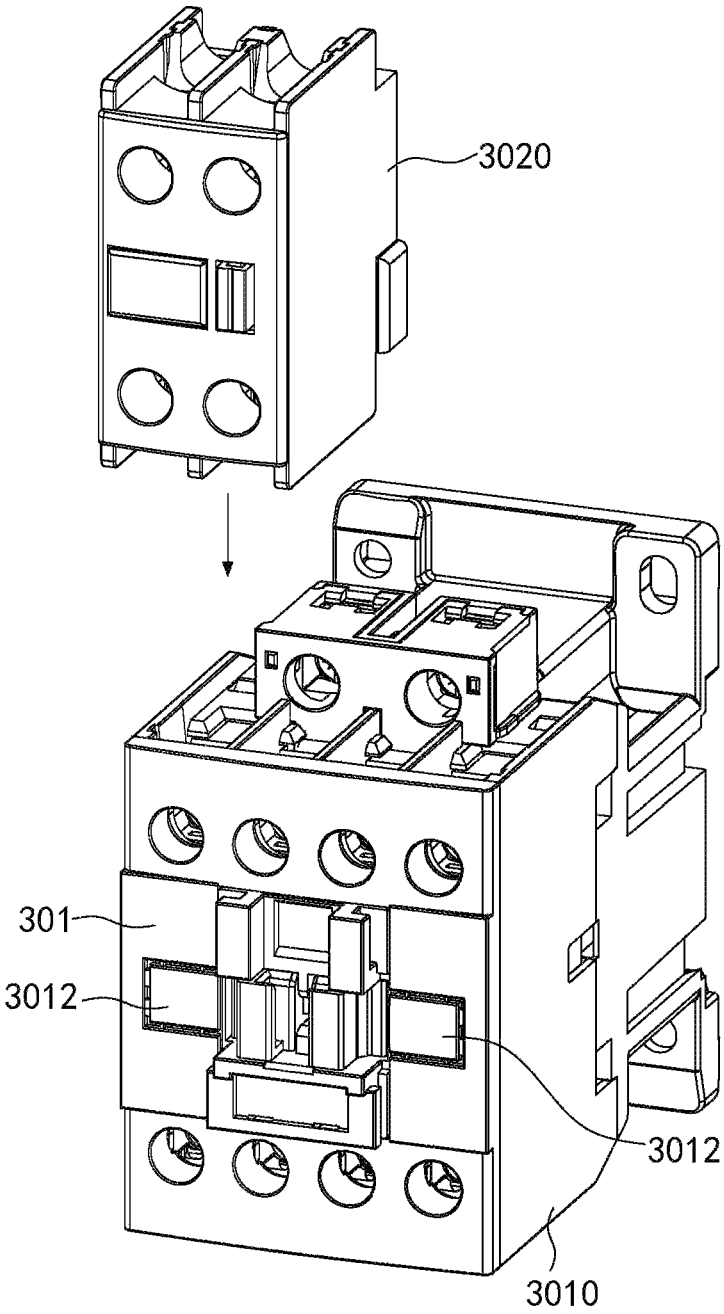
FIG. 25 is a schematic view showing the process of assembling the two sets of function assistant modules.
Figure 26:
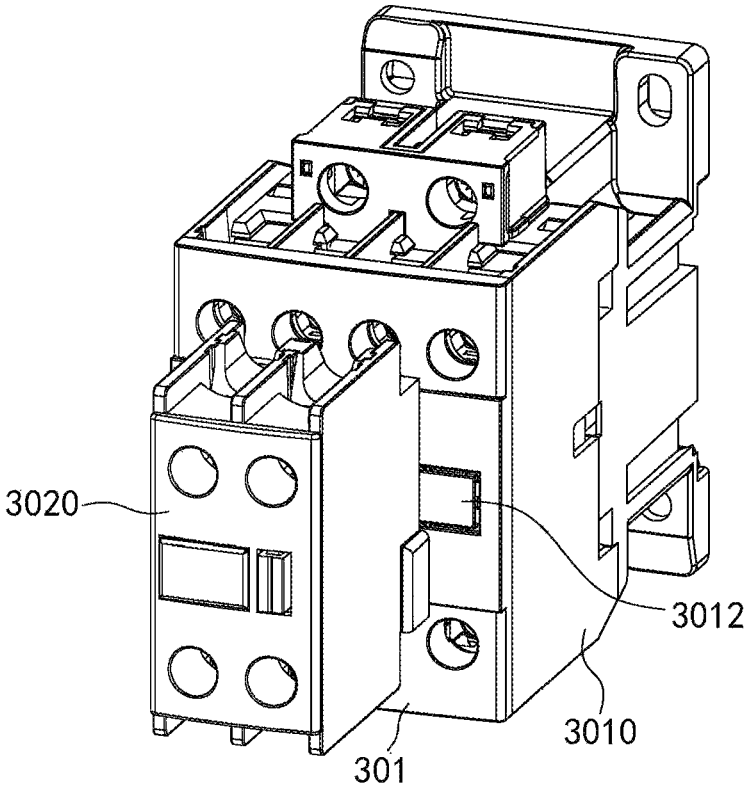
FIG. 26 is a schematic view showing that the two sets of function assistant modules are finished assembling.

As shown in FIG. 18 to FIG. 29, the invention discloses a cover structure of the contactor mounted on the contactor housing 3010. As shown in FIG. 23, a hollow portion 3011 is formed on the cover 3011, the hollow portion 3011 allows a part of the contact carrier of the contactor exposed from the cover 301 to accommodate therein, at the same time, the hollow portion 3011 may also allow two sets of function assistant modules 3020 to be assembled in, the function assistant module 3020 may be a contact terminal assistant module, a delay assistant module and so on, as shown in FIG. 26, two opposite first protective covers 3012 which may be pried are disposed at two sides of the hollow portion 3011, as shown in FIG. 18 and FIG. 19.

The pried connection between the first protective cover 3012 and the cover 301 may be: the first protective cover 3012 is connected to the cover 301 via ribs or tearing lines, in the embodiment, the first protective cover 3012 is connected to the cover 301 via the ribs 30121, as shown in FIG. 19, the two first protective covers 3012 are co-axial and disposed in the same plane.

Figure 20:
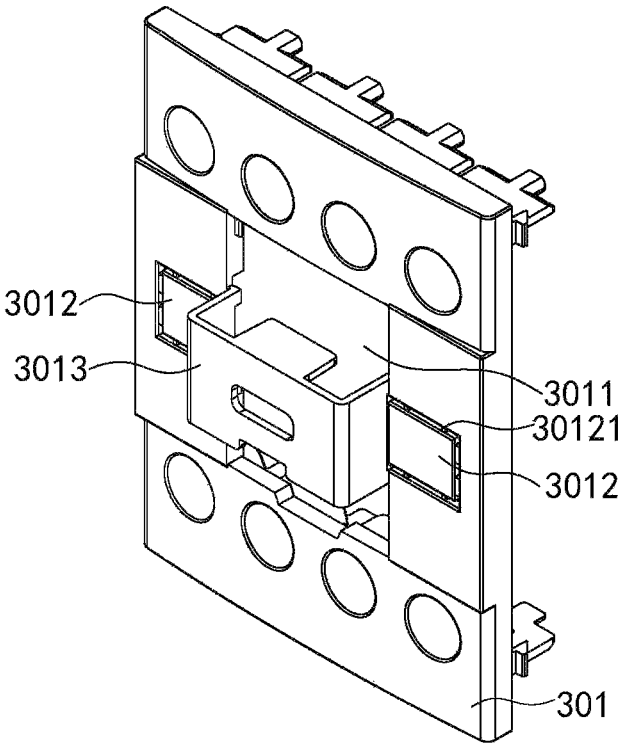
FIG. 20 is a schematic view showing the structure of the invention after the second protective cover is assembled.

As shown in FIG. 20 to FIG. 22, two sides of the hollow portion 3011 are further disposed with second protective covers 3013 which may also be pried. The second protective covers 3013 are protruded and disposed on the cover 301. The protruding part is used to accommodate a part of the contact carrier exposed from the cover 301.

The pried structure between the second protective cover 3013 and the cover 301 may be: the second protective cover 3013 is connected to the cover 301 via ribs or tearing lines, in the embodiment, the two first protective covers 3012 and the two second protective covers 3013 are co-axially disposed, as shown in FIG. 21.

Figure 27:
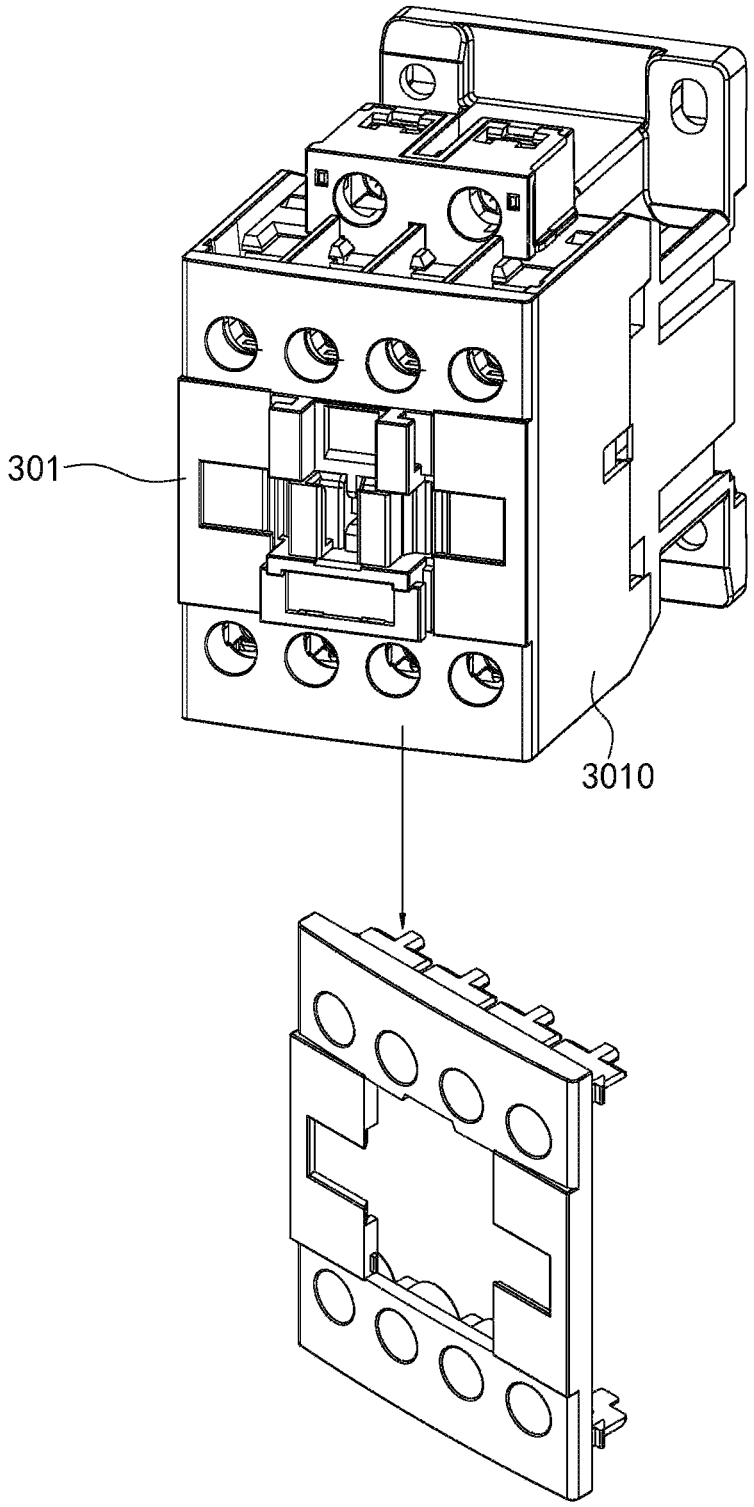
FIG. 27 is a schematic view showing the state that the second protective covers and the first protective covers are pried when four sets of function assistant modules are assembled.
Figure 28:
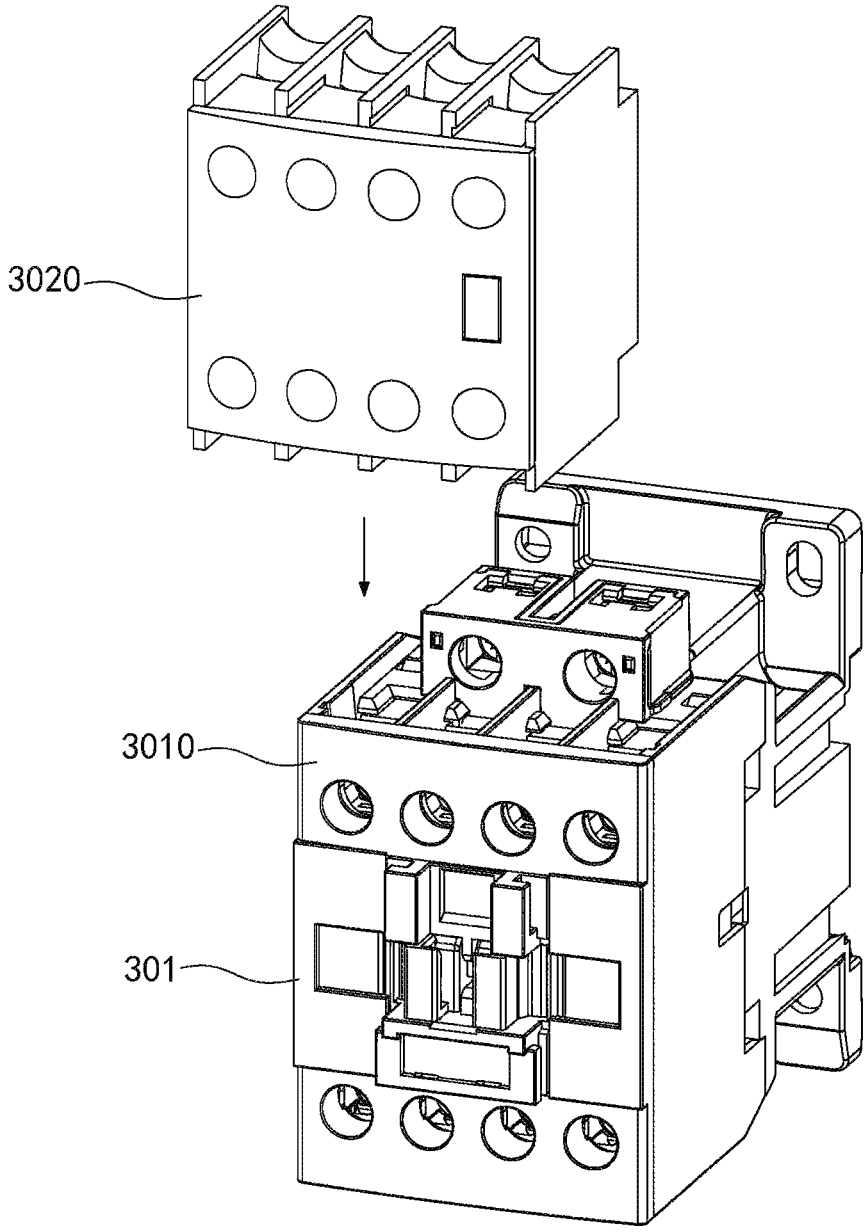
FIG. 28 is a schematic view showing the process of assembling the four sets of function assistant modules.
Figure 29:
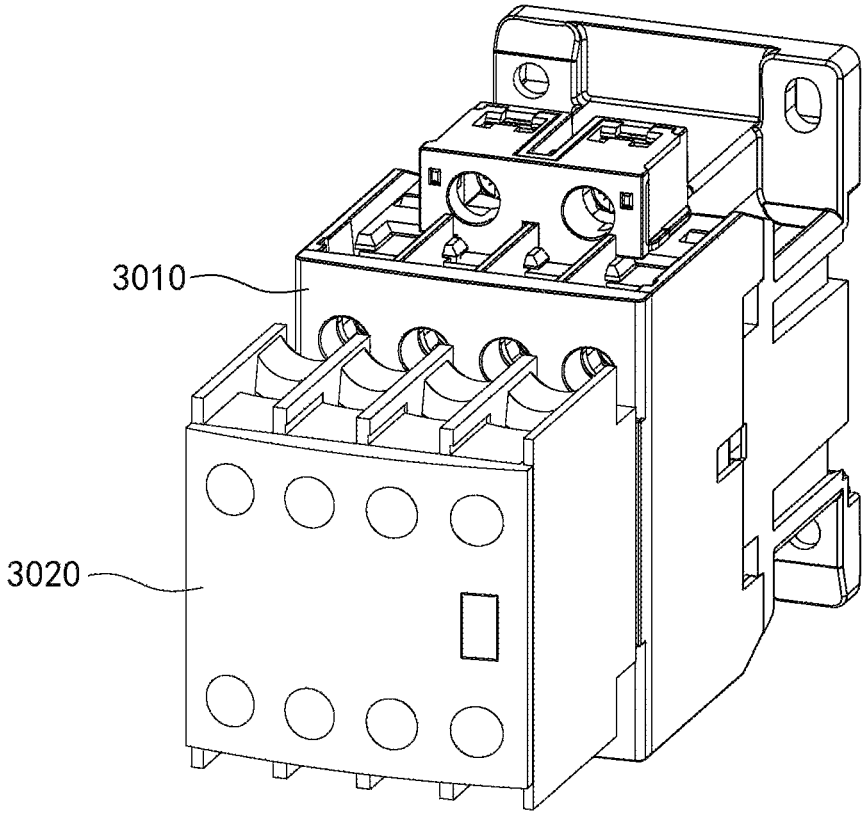
FIG. 29 is a schematic view showing that the four sets of function assistant modules are finished assembling.

Two opposite first protective covers 3012 which may be pried are disposed at two sides of the hollow portion 3011, when two sets of function assistant modules 3020 needs to be assembled, it is not needed to pry the first protective covers 3012, and as shown in FIG. 24 to FIG. 26, when four sets of function assistant modules 3020 needs to be assembled, two first protective covers 3012 at two sides of the hollow portion 3011 are pried to assemble the function assistant modules 3020, to allow the function assistant module 3020 to operate normally. As shown in FIG. 27 to FIG. 29.

At the same time, two opposite second protective covers 3013 which may be pried are disposed at two sides of the hollow portion 3011, the second protective covers 3013 are protruded and disposed on the cover 301, the protruding part allows the part of the contact carrier exposed from the cover 201 to accommodate therein. Thusly when the function assistant modules 3020 are not assembled, as shown in FIG. 23, the part of the contact carrier exposed from the cover 301 is accommodated in the protruding part of the second protective cover 3013, which effectively avoids human from pressing on the contact carrier to make the contactor conduct and damaging the contactor controlling equipment and affecting personal safety.

As shown from FIG. 24 to FIG. 26, when it is needed to assemble two sets of the function assistant modules 3020, the second protective covers 3013 are pried to form an assembling portion for assembling, at that moment, the first protective covers 3012 do not need to be pried.

As shown from FIG. 27 to FIG. 29, when it is needed to assemble four sets of function assistant modules 3020, two first protective covers 3012 at two sides of the hollow portion are further pried, which is easy to assemble and cost-saving.

The Fourth Technical Solution

Hereinafter the detail embodiment is illustrated accompanying with FIG. 30 to FIG. 35.

As shown in FIG. 30 to FIG. 34, the invention discloses a rail mounting structure of electric device, a mounting slot 4011 is formed on the base 401 of the electric device 40100, and at least one first fixing clasp 4012 is formed at a side of the mounting slot 4011. In the embodiment, there is only one first fixing clasp 4012, and a first clasping slot 4013 is formed between the first fixing clasp 4012 and the base 401.

A second fixing clasp 4014 is formed at another side of the mounting slot 4011, and a second clasping slot 4015 is formed between the second fixing clasp 4014 and the base 401.

A first limiting block 4016 and a second limiting block 4017 are formed at two sides of the second fixing clasp 4014, respectively, a first limiting slot 4018 is formed between the first limiting block 4016 and the base 401, and a second limiting slot 4019 is formed between the second limiting block 4017 and the base 401. The first limiting slot 18 and the second limiting slot 19 are arc-shaped limiting slots (40181, 40191), and tapered guiding surfaces (40161, 40171) are formed respectively on the first limiting block 4016 and the second limiting block 4017.

Two end of a snap spring 402 are disposed in the first limiting slot 4018 and the second limiting slot 4019, respectively, and form linear contact with the side walls of the first limiting slot 18 and the second limiting slot 19. The middle stage of the snap spring 402 is in the second clasping slot 4015.

Two ends of the snap spring 402 linearly contact the side wall of the first limiting slot 4018 and the side wall of the second limiting slot 4019, thusly the snap spring 402 is assembled stably and not easy to fall off.

In the embodiment, ribs (40182, 40192) are formed on the side walls of the first limiting slot 4018 and second limiting slot 4019, the ribs (40182, 40192) are disposed above the snap spring 402, which effectively avoid the falling off of the snap spring 402 due to warping of the two ends of the snap spring 402 under pressure.

Figure 34:
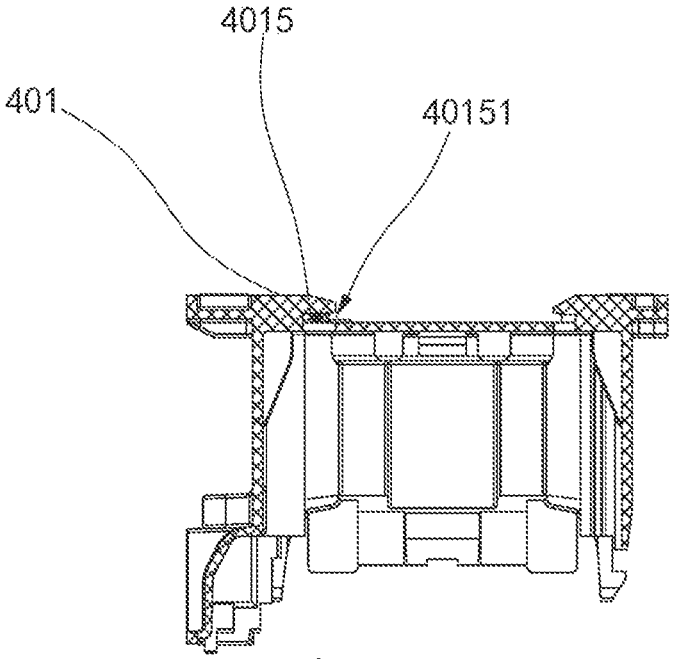
FIG. 34 is a sectional view of the invention.
Figure 35:
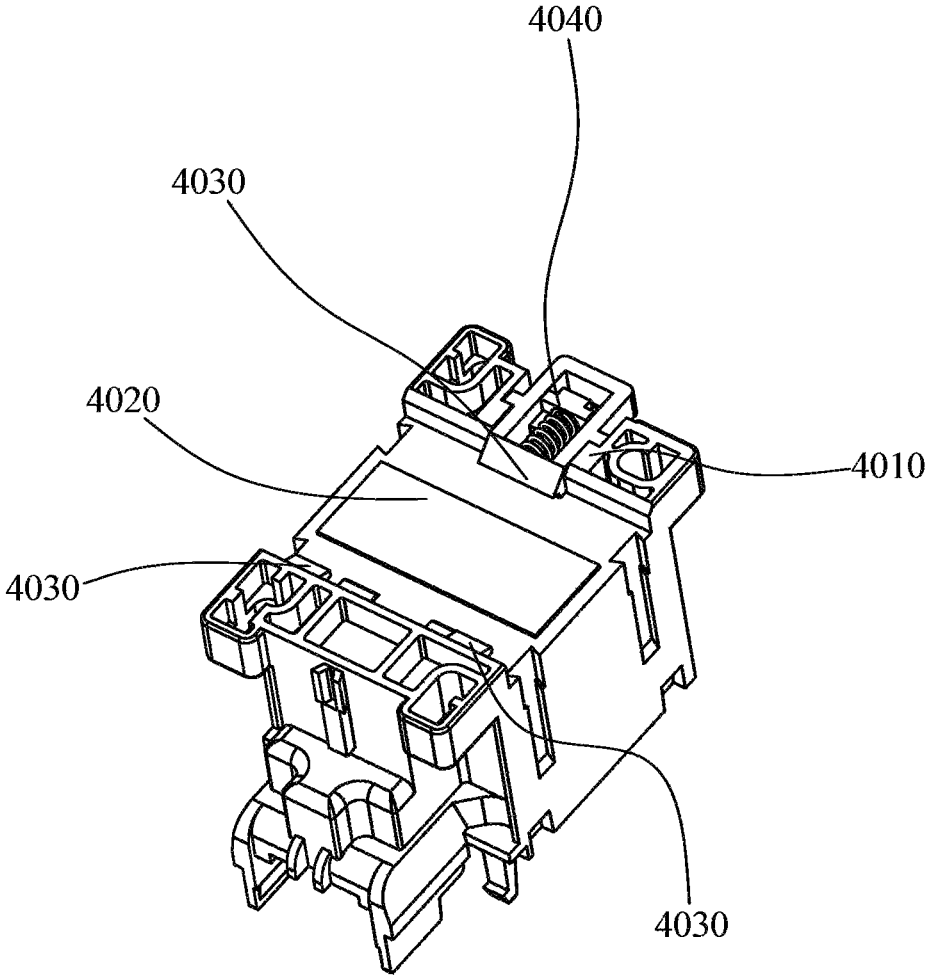
FIG. 35 is a schematic view of the rail mounting structure in the conventional technology.

As shown in FIG. 34, the width of the second clasping slot 4015 becomes wider gradually from inner part to the inserting opening 40151 of the snap spring 402, which effectively avoid the falling off of the snap spring 402 due to warping of the middle stage of the snap spring 402 under pressure.

In the embodiment, the second fixing clasp 4014, the first limiting block 4016 and the second limiting block 4017 are disposed as a reverse-trapezoid shape, correspondingly, the snap spring 402 is a reverse-trapezoid shape with a top opening, the middle stage thereof is straight or curved stage, the layout is compact in structure, and the rail is assembled stably.

Figure 30:
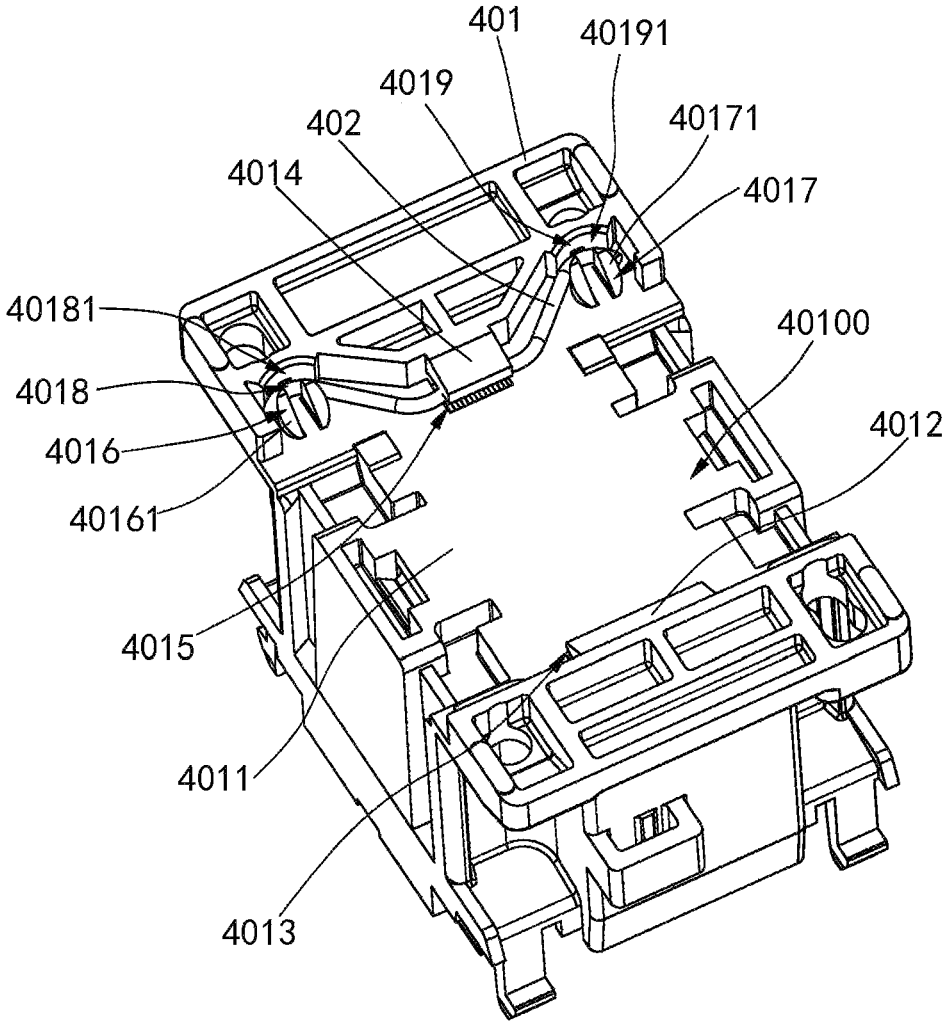
FIG. 30 is a schematic view showing the structure of the invention.
Figure 31:
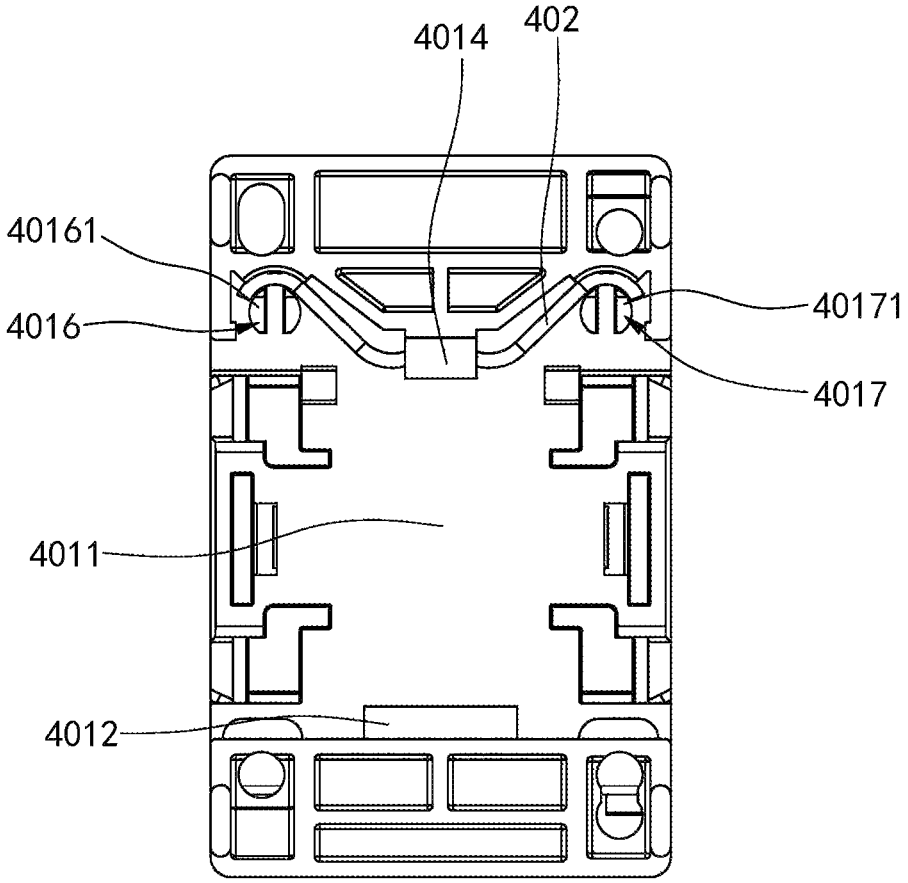
FIG. 31 is a top view of the invention.

In the embodiment, as shown in FIG. 30, the first limiting block 4016 and the second limiting block 4017 are formed by two parallel half-cylinders, and tapered surfaces are formed on each of the half-cylinders, respectively, to form the tapered guiding surfaces (40161, 40171). Correspondingly, two ends of the snap spring 402 are arc-shaped, and the arc-shaped stage matches the two parallel half-cylinders, which facilitates assembling.

when the electric device is mounted via the rail 403, one side of the rail 403 is disposed in the first clasping slot 4013, the other side is disposed in the second clasping slot 4015 and elastically contact the middle stage of the snap spring 402 to elastically deform the snap spring 402, two ends of the snap spring 402 abut against the base 401, a leaf spring principle of the snap spring 402 makes the rail 403 fixed stably. The rail 403 may be mounted from a side, which is easy to mount, and only one snap spring 402 is used to mount the electric device on the rail 403, which saves manufacturing and usage cost.

Figure 32A:
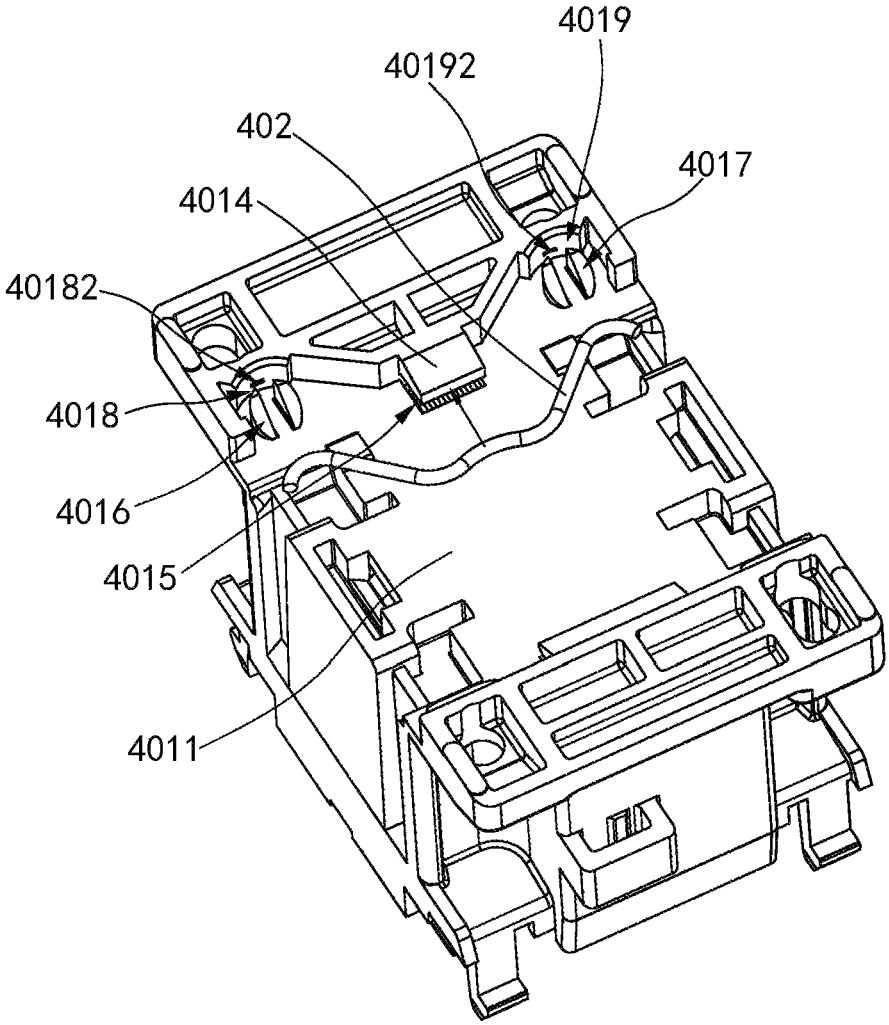
FIG. 32*a* is a first schematic view showing the assembling process of the invention.
Figure 32B:
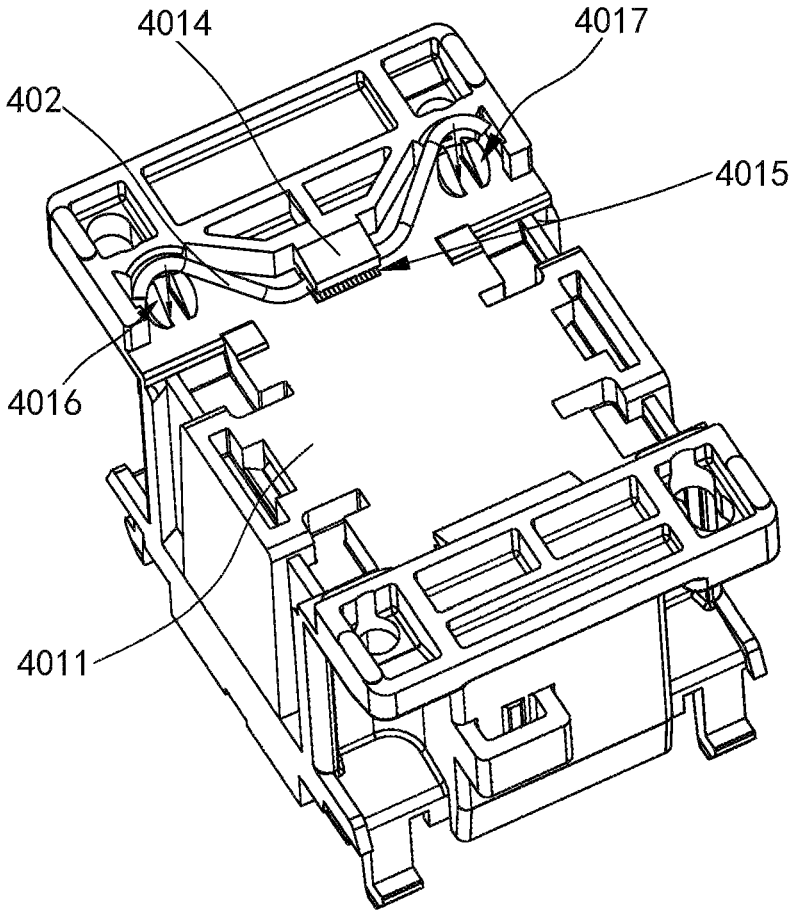
FIG. 32*b* is a second schematic view showing the assembling process of the invention.
Figure 32C:
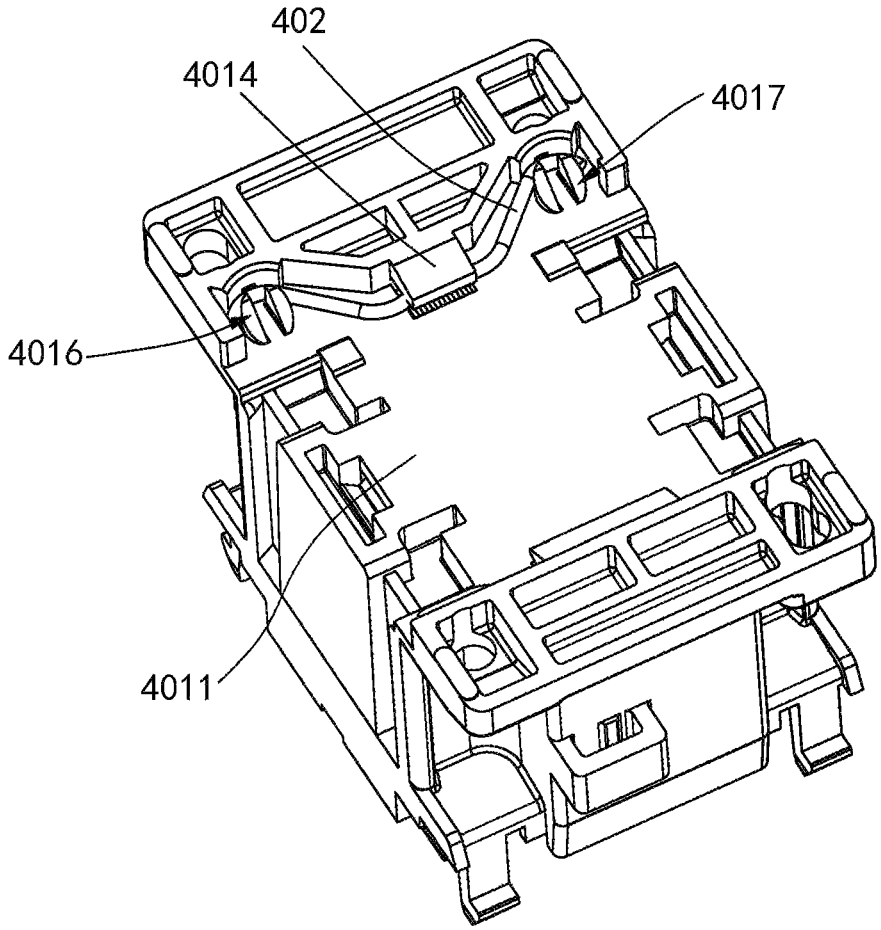
FIG. 32*c* is a third schematic view showing the assembling process of the invention.
Figure 33:
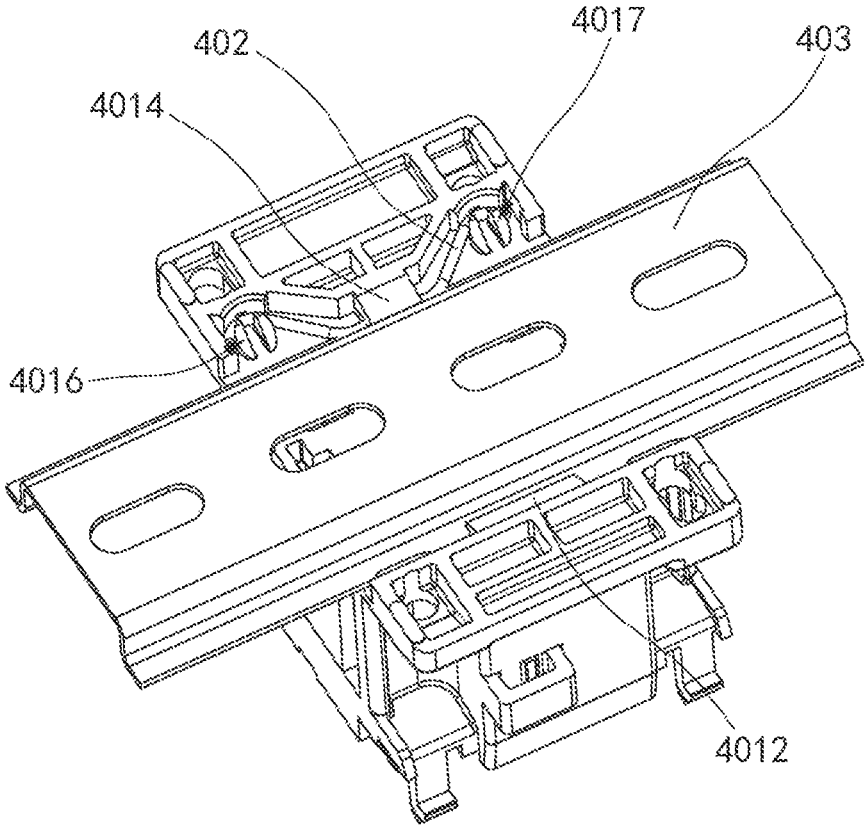
FIG. 33 is a schematic view of assembling the rail of the invention.

During assembling the snap spring 402, as shown in FIG. 32, a robot is used to dispose the snap spring 402 in the mounting slot 4011, the middle stage of the snap spring 402 corresponds to the second fixing clasp 4014, two ends of the snap spring 402 correspond to the first limiting block 4016 and the second limiting block 4017, as shown in FIG. 32*b*, the snap spring 402 is moved to get close to the second fixing clasp 4014, to make the middle stage of the snap spring 402 disposed in the second clasping slot 4015, and two ends of the snap spring 402 slide into the first limiting slot 4018 and the second limiting slot 4019 via the tapered guiding surfaces (40161, 40171), as shown in FIG. 32*c*, the assembling process have no structure block, which may achieve automatic assembling and save manufacturing cost.

After assembling, if the assembling has error, the snap spring 402 is easy to take out, which is, only to lift two ends of the snap spring 402, then slide the snap spring 402 out of the second clasping slot 4015.

The invention takes a contactor as an example to illustrate the detailed structure, the rail mounting structure of the electric device may also be used in device such as the circuit breaker, the switch and the thermal relay.

Apparently, one of ordinary skill in the art can make various changes and modifications to the present disclosure without departing from the spirit and scope of the invention. Thus, the present disclosure intends to encompass such changes and modifications provided that those changes and modifications fall within the scope of claims of the present invention and equivalents thereof.

What is claimed is:

1. A clasping connection structure of a contactor, comprising a base, a housing and a bobbin; accommodating chambers being formed on the housing and configured to accommodate contact heads therein, any two adjacent accommodating chambers being separated via a side plate, wherein, the bobbin and the housing are connected via a first clasp, the first clasp is protruded and extended at a central side plate of the housing, the central side plate is located at an axial center line of the housing, correspondingly, a limiting slot for matching with the central side plate is formed on the bobbin inserted in the housing, the central side plate passes through the limiting slot, the clasp of the central side plate is hooked on the bobbin at a side of the limiting slot, to connect the bobbin and the housing, the housing and the base are connected via a second clasp.

2. The clasping connection structure of the contactor according to claim 1, wherein the clasp of the central side plate is provided with a tapered-pushing surface and a clamping stopper surface adjacent with each other, the clamping stopper surface abuts against the bobbin at a side of the limiting slot.

3. The clasping connection structure of the contactor according to claim 1, wherein the second clasp is a hook formed on the base, a clasping slot for matching with the hook is formed on the housing, and the hook is engaged into the clasping slot to connect the base and the housing.

4. The clasping connection structure of the contactor according to claim 2, wherein the second clasp is a hook formed on the base, a clasping slot for matching with the hook is formed on the housing, and the hook is engaged into the clasping slot to connect the base and the housing.

* * * * *